US007002297B2

(12) United States Patent
Aoki et al.

(10) Patent No.: US 7,002,297 B2
(45) Date of Patent: Feb. 21, 2006

(54) PLASMA DISPLAY PANEL AND MANUFACTURING METHOD FOR THE SAME

(75) Inventors: Masaki Aoki, Minoo (JP); Mitsuhiro Ohtani, Sakai (JP); Junichi Hibino, Neyagawa (JP); Keisuke Sumida, Hirakata (JP); Hideki Asida, Kadoma (JP); Shinya Fujiwara, Kyoto (JP); Hideki Marunaka, Kyoto (JP); Tadashi Nakagawa, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/874,737

(22) Filed: Jun. 23, 2004

(65) Prior Publication Data

US 2004/0232840 A1 Nov. 25, 2004

Related U.S. Application Data

(62) Division of application No. 09/913,421, filed as application No. PCT/JP00/09009 on Dec. 19, 2000, now Pat. No. 6,777,872.

(30) Foreign Application Priority Data

Dec. 21, 1999 (JP) ..... 11-362267
Oct. 25, 2000 (JP) ..... 2000-325290

(51) Int. Cl.
*H01J 17/49* (2006.01)
*H01J 1/02* (2006.01)

(52) U.S. Cl. ..... 313/584; 313/582; 445/46

(58) Field of Classification Search ..... 313/582, 313/586, 587, 585, 484–485; 345/60; 445/24, 445/25, 46

See application file for complete search history.

(56) References Cited

U.S. PATENT DOCUMENTS 5,736,815 A * 4/1998 Amemiya ..... 313/586
6,075,319 A * 6/2000 Kanda et al. ..... 313/584

FOREIGN PATENT DOCUMENTS

| | | | |
|---|---|---|---|
| EP | 834899 | A2 * | 4/1998 |
| JP | 09-231909 | | 9/1997 |
| JP | 09-245652 | | 9/1997 |
| JP | 09-171717 | | 6/1998 |
| JP | 10-255669 | | 9/1998 |
| JP | 11-096918 | | 4/1999 |
| JP | 11-130471 | | 5/1999 |
| JP | 11-213893 | | 8/1999 |
| JP | 11-329236 | | 11/1999 |

* cited by examiner

*Primary Examiner*—Karabi Guharay

(57) ABSTRACT

To provide a technique for relatively easily preventing yellowing of a PDP that uses silver electrodes, and a PDP utilizing the technique that is capable of displaying images with high luminance and high quality. To form the electrodes, an alloy composed of Ag as a main constituent and a transition metal (at least one selected from Cu, Cr, Co, Ni, Mn, and Fe) is used, or an oxide of such a transition metal is added. Alternatively, an alloy composed of Ag as a main constituent and a metal (at least one selected from Ru, Rh, Ir, Os, and Re) is used, or an oxide of such a metal is added. Alternatively, Ag particles whose surfaces are each coated with a metal (Pd, Cu, Cr, Ni, Ir, or Ru) or a metal oxide ($SiO_2$, $Al_2O_3$, NiO, $ZrO_2$, $Fe_2O_3$, ZnO, $In_2O_3$, CuO, $TiO_2$, or $Pr_6O_{11}$) are used.

19 Claims, 12 Drawing Sheets

⇓ HEATED (RESIN DECOMPOSES)

⇓ BAKED

FIG.10
FIG.10A
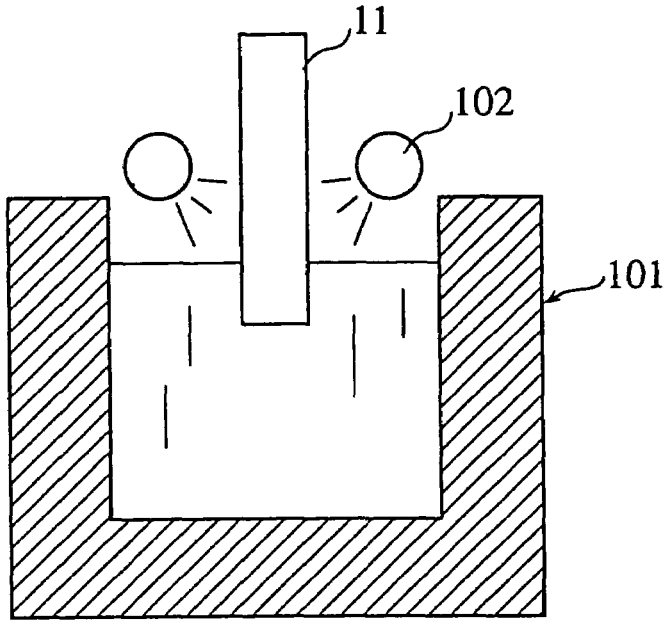
FIG.10B
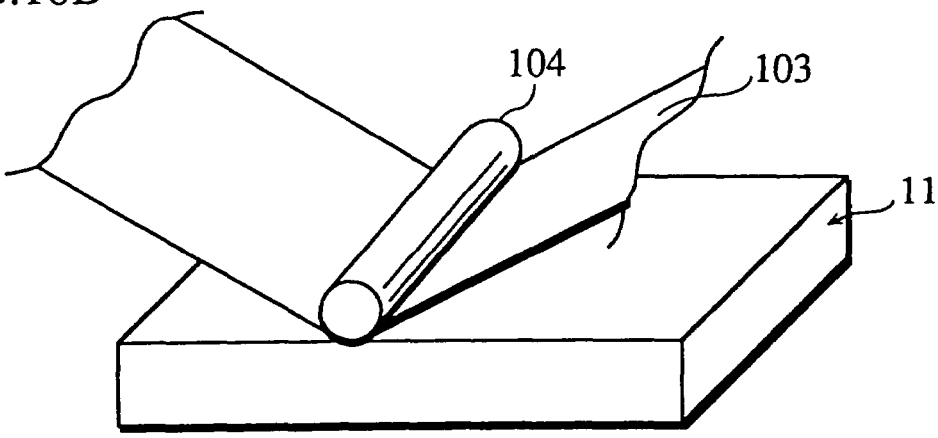
FIG.10C
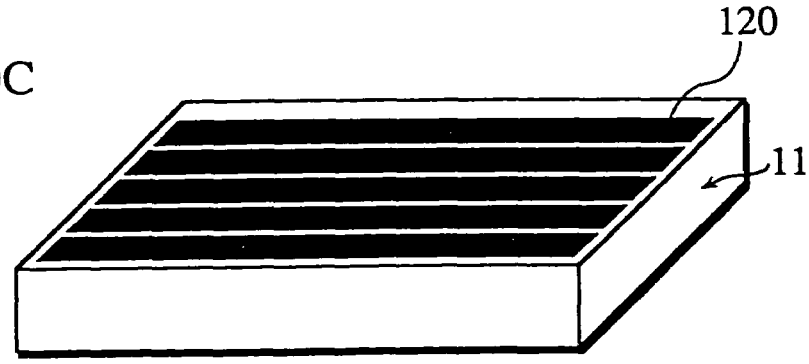

PLASMA DISPLAY PANEL AND MANUFACTURING METHOD FOR THE SAME

RELATED APPLICATIONS

This application is a divisional application with a U.S. Ser. No. 09/913,421, filed Aug. 13, 2001 now U.S. Pat. No. 6,777,872, which is a 371 of PCT/JP00/09009, filed Dec. 19, 2000.

TECHNICAL FIELD

The present invention relates to a plasma display panel for use in a display device or the like, and a manufacturing method for the same.

BACKGROUND ART

Recently, calls for higher performances such as high-definition (high-vision) displays and flat panel displays have grown in the field of displays. In response to these calls, various research and development are being made.

Typical flat panel displays are liquid crystal displays (LCDs) and plasma display panels (PDPs). Particularly, PDPs are thin and suitable for large-scale screens, with products using 50-inch class PDPs having already been developed.

PDPs can roughly be divided into two types: direct current (DC) type; and alternating current (AC) type. The present mainstream is AC-type PDPs that are suitable for being made larger in size.

In general, PDPs are constructed of phosphor cells of respective colors arranged in matrix. As one example, Japanese Laid-Open Patent Application No. 9-35628 discloses an AC surface-discharge type PDP. This PDP has the following panel construction. A front glass substrate and a back glass substrate are arranged in parallel with barrier ribs interposed between them. On the front glass substrate, pairs of display electrodes (scanning electrodes and sustaining electrodes) are formed in parallel. These electrodes are covered with a dielectric layer. On the back glass substrate, address electrodes are formed so as to face the scanning electrodes at right angles. Phosphor layers of respective colors (red, green, and blue) are formed in spaces divided by the barrier ribs between the front and back substrates. A discharge gas is enclosed in the spaces to form cells that emit red, green and blue light. By a driving circuit applying voltage to each electrode, discharge occurs and ultraviolet rays are emitted. Phosphor particles (red, green, and blue) in the phosphor layers are excited with these ultraviolet rays to emit light, resulting in a luminescent display.

In the PDP described above, glass plates manufactured from a sodium borosilicate glass material using a float method are typically used for the front glass substrate and the back glass substrate. For the display electrodes and the address electrodes, Cr—Cu—Cr (chromium-copper-chromium) electrodes are sometimes used, and silver electrodes that are relatively cheap are often used.

In general, the silver electrodes are formed using a thick-film forming method. To be more specific, a silver paste made of Ag particles, a glass frit, resin, solvent, and the like is applied as a pattern using a screen-printing method. Alternatively, a film made of Ag particles, a glass frit, resin, and the like is applied using a lamination method and is patterned. In either case, the applied paste or the applied film is baked at the temperature of 500° C. or higher to fuse Ag particles together for improving conductivity as well as to remove resin.

The dielectric layer is usually formed by applying a paste made of powdered lead glass with a low melting point or the like and resin, using the screen-printing method, a die coat method, the lamination method, or the like, and baking the applied paste at the temperature of 500° C. or higher.

The PDP using such silver electrodes as described above is known to have the following problem. From the silver electrodes, Ag diffuses as ions into the glass substrate and the dielectric layer. The diffused Ag ions are reduced to generate Ag colloids. Due to this, the glass substrate and the dielectric layer yellow easily. This yellowing causes a decrease in the color temperature of full-white images when the PDP is driven, deteriorating image quality of the PDP.

This yellowing of the glass substrate and the dielectric layer causes deterioration in the luminance of blue cells and a decrease in the color temperature of full-white images.

To solve this yellowing problem in the PDP, as one example, Japanese Laid-Open Patent Application No. 10-255669 discloses a technique for abrading a surface layer with a thickness of 1 $\mu$m to 1000 $\mu$m of a glass substrate, by mechanically polishing the surface of the glass substrate.

This technique is considered effective in preventing the yellowing of the glass substrate. However, it is extremely difficult to uniformly abrade 1 $\mu$m or thicker surface part of such a large glass substrate that is used in the PDP in a short period of time. For example, it takes at least several tens minutes to abrade the 1 $\mu$m-thick surface part of the glass substrate with an Oskar-type polishing device. Furthermore, by abrading 1 $\mu$m or thicker surface part of the glass substrate, the thickness of the glass substrate as a whole may become uneven.

Accordingly, new solutions to the yellowing in the PDP that use the silver electrodes are being sought.

DISCLOSURE OF THE INVENTION

The present invention aims to provide a technique for relatively easily preventing a PDP that use the sliver electrodes from yellowing, and also, to provide a PDP that is capable of displaying images with high luminance and high quality utilizing this technique. Note that the term "silver electrode" as used herein is intended to include an electrode substantially made of silver such as a silver alloy electrode.

The present invention proposes the following four techniques with which the above aim can be fulfilled.

A first technique is to form the silver electrodes from an alloy which is mainly composed of Ag and contains a transition metal (at least one selected from the group consisting of Cu, Cr, Co, Ni, Mn, and Fe), or to form the silver electrodes from Ag and glass that contains a transition metal oxide (at least one selected from the group consisting of CuO, CoO, NiO, $Cr_2O_3$, MnO, and $Fe_2O_3$).

A second technique is to form the sliver electrodes from an alloy which is mainly composed of Ag and contains a metal (at least one selected from the group consisting of Ru, Rh, Ir, Os, and Re), or to form the silver electrodes from Ag and glass that contains a metal oxide (at least one selected from the group consisting of $RuO_2$, RhO, $IrO_2$, $OsO_2$, $ReO_2$, and PdO).

A third technique is to form the silver electrodes from Ag particles each coated with a metal (such as Pd, Cu, Cr, Ni, Ir, or Ru) or with a metal oxide (such as $SiO_2$, $Al_2O_3$, NiO, $ZrO_2$, $Fe_2O_3$, ZnO, $In_2O_3$, CuO, $TiO_2$, or $Pr_6O_{11}$).

Here, the following ways (1) to (3) can be employed for coating a surface of each Ag particle with a metal or a metal oxide:

(1) A surface of an Ag particle is coated with a metal using an electroless plating method.

(2) A surface of an Ag particle is coated with a metal oxide or a metal using a mechanofusion method.

(3) A surface of an Ag particle is coated with a metal oxide using a sol-gel method.

A fourth technique is to provide the following setting in a glass substrate for use in the PDP. In the glass substrate for use in the PDP, the concentration of metal ions to be contained in a part of the substrate from its surface to 5 $\mu$m in depth is set at 1000 ppm or less, the metal ions possessing reducing action on Ag ions.

Such a glass substrate for use in the PDP can be manufactured as follows. A normal glass substrate is made to go through a step in which metal ions that possess reducing action on Ag ions are removed by etching the substrate, or a step in which the reducing action of the metal ions on Ag ions is deactivated by heating the substrate.

The yellowing of the glass substrate and the dielectric layer can be prevented with any of the above four techniques, thereby improving the luminance of blue cells of the PDP and the color temperature of full-white images. Also, when any of the above four techniques is employed, the conductivity of the sliver electrodes can be ensured.

The following describes the reasons why the above four techniques of the present invention can prevent such yellowing.

FIG. 3 is for explaining a mechanism that causes yellowing of a glass substrate and a dielectric layer in a conventional PDP.

As shown in the figure, yellowing of the glass substrate occurs through the following steps I to IV:

I. During a baking process for forming silver electrodes or during a baking process for forming a dielectric glass layer, Ag in the electrodes is ionized.

II. The Ag ions diffuse into the glass substrate surface and the dielectric layer.

III. The diffused Ag ions are reduced by metal ions that exist in the vicinity of the glass substrate surface and in the dielectric layer (the metal ions possess reducing action on Ag ions, and include Sn ions that exist mainly around the glass substrate surface, and Na ions and Pb ions that exist in the dielectric glass).

IV. The reduced Ag is then precipitated as Ag colloidal particles, and the Ag colloidal particles grow.

The Ag colloidal particles have the absorption region at the wavelength of 400 nm, and so cause the yellowing of the substrate and the dielectric layer.

With regard to the mechanism for silver to cause yellowing of glass, "*Glass Handbook*" (ASAKURA SHOTEN: Jul. 15, 1977, P. 166) describes the following phenomena. When $Ag^{+}$ and $Sn^{2+}$ coexist in the glass, the thermal reduction reaction proceeds as $2Ag^{+}+Sn^{2+}\rightarrow 2Ag+Sn^{4+}$. The book also describes that Ag colloids cause coloring of the glass. Another relevant book is "*Journal of Non Crystalline Solids Vol*50, (1982), P107–117" written by J. E. SHELBY and J. VITKO. Jr.

In view of these books' teachings, the first technique of the present invention enables the transition metal or the transition metal oxide included in the silver electrodes to prevent Ag ions from diffusing, thereby preventing Ag colloidal particles from growing. Moreover, the transition metal or the transition metal oxide is colored with a red to blue color that is complementary to a yellow color. This also helps prevent the yellowing.

Also, with the second technique, platinum group metals (or Re) or their oxides included in the silver electrodes have the pinning effect which suppresses Ag ions to diffuse into the glass substrate and in the dielectric glass, and at the same time suppresses Ag ions to be reduced. Accordingly, a smaller number of Ag colloidal particles end up growing, thereby preventing the yellowing.

Also, with the third technique, metal oxides or metals coating the surfaces of the Ag particles prevent Ag ions from diffusing during baking. This reduces a number of Ag collide particles that end up growing.

Also, with the fourth technique, the concentration of metal ions that possess reducing action on Ag ions in the vicinity of the surface of the substrate in the PDP is set at 1000 ppm or less. Therefore, even if Ag ions diffuse from the silver electrodes onto the surface of the substrate, a chance of the Ag ions being reduced is low. Accordingly, a smaller number of Ag colloidal particles end up growing.

BRIEF DESCRIPTION OF THE DRAWINGS

FIGS. 10A to 10C are each for explaining a surface etching process of a front glass substrate;

DESCRIPTION OF THE PREFERRED EMBODIMENTS

First Embodiment

Figure 1:
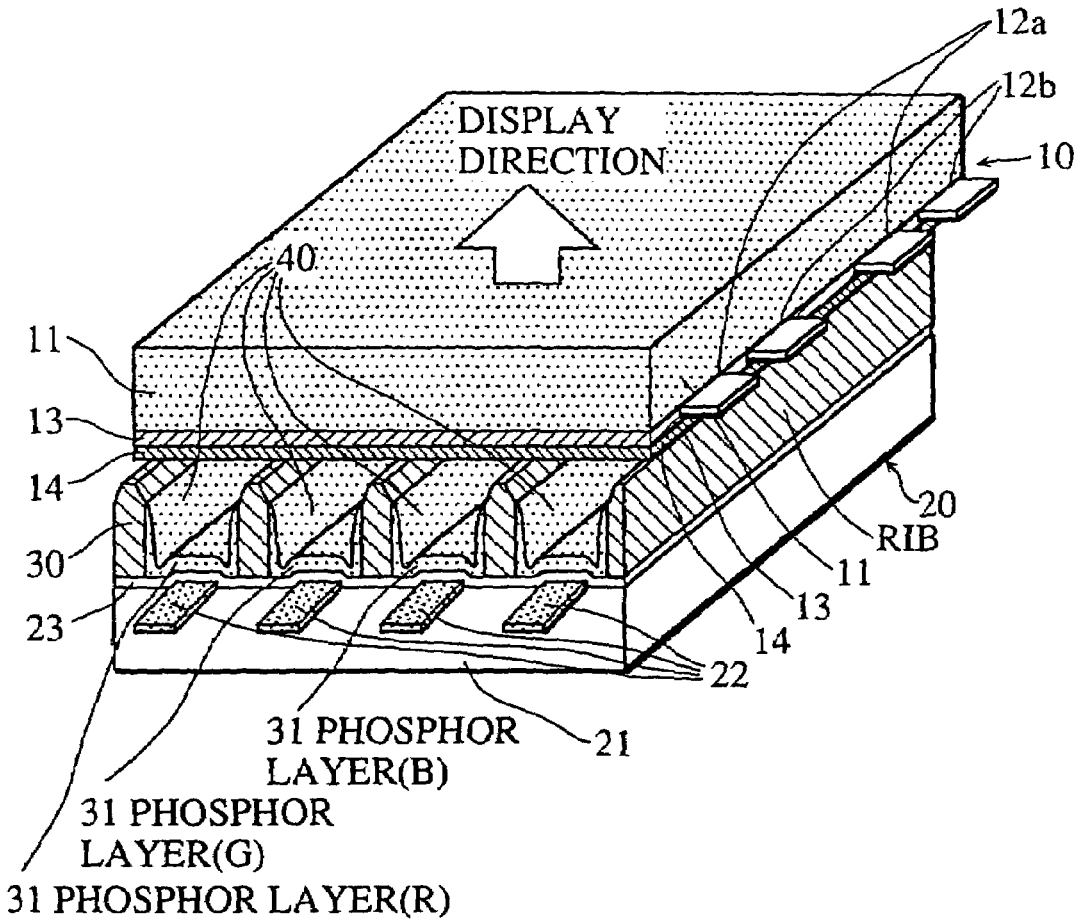
FIG. 1 is a perspective view showing the essential components of an AC surface discharge type PDP relating to preferred embodiments of the present invention.

FIG. 1 is a perspective view showing the essential components of an AC surface discharge type PDP relating to the present embodiment. The figure partly shows a display area of the PDP.

This PDP is constructed of a front panel 10 and a back panel 20 arranged in parallel leaving a space between them.

The front panel 10 is formed from a front glass substrate 11, on whose inward surface display electrodes 12 as the first electrodes (formed of scanning electrodes 12*a* and sustaining electrodes 12*b*), a transparent dielectric layer 13 and a protective layer 14 are formed in the stated order. The back panel 20 is formed from a back glass substrate 21, on whose inward surface address electrodes 22 as the second electrodes, a white dielectric layer 23, and barrier ribs 30 are formed in the stated order, with phosphor layers 31 being formed between the barrier ribs 30. Note that the phosphor layers 31 of respective colors of red, green and blue are repeatedly arranged in the stated order of the colors.

Glass plates manufactured using the float method are used for the front glass substrate 11 and the back glass substrate 21.

The space between the front panel 10 and the back panel 20 is divided into discharge spaces 40 by constructing the barrier ribs 30 that run in strips. A discharge gas is introduced into these discharge spaces 40.

The display electrodes 12 and the address electrodes 22 are both arranged as stripes, the display electrodes 12 being placed at right angles to the barrier ribs 30, and the address electrodes 22 being parallel with the barrier ribs 30. The panel composed of the front panel 10 and the back panel 20 has a structure in which the points where the display electrodes 12 and the address electrodes 22 crossover form cells to emit red, green and blue light.

Figure 2A:
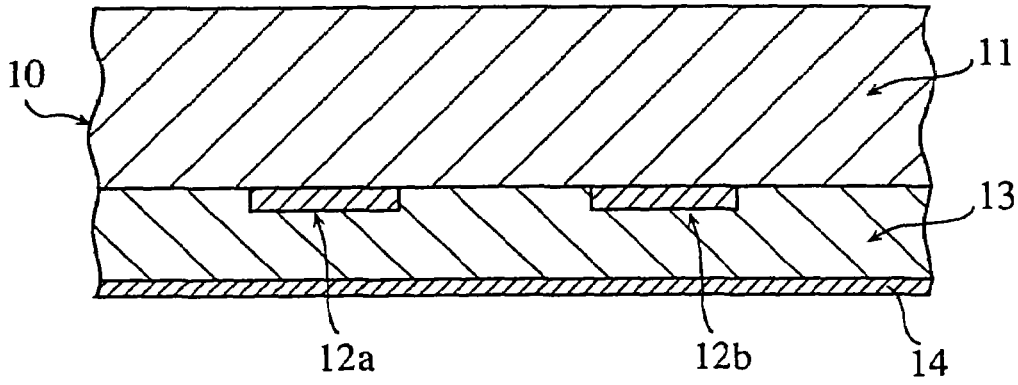
FIGS. 2A and 2B each show an example of a sectional view partially showing a front panel in the PDP.
Figure 2B:
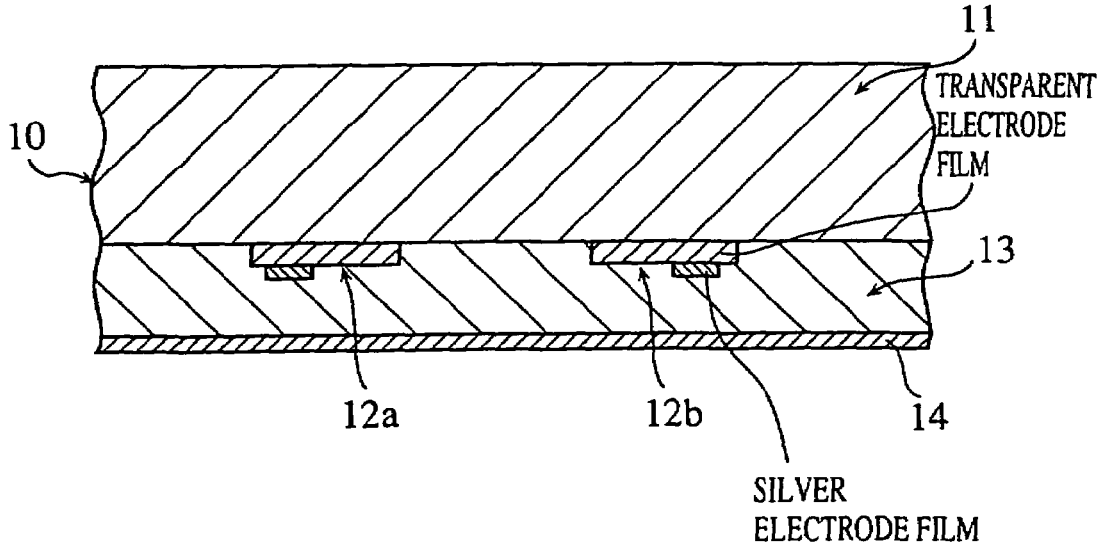

FIGS. 2A and 2B each show an example of a sectional view partially showing the front panel 10.

In the front panel 10, the display electrodes 12*a* and 12*b* each may be formed simply from a silver electrode film as shown in FIG. 2A, or may have an electrode construction in which a thin silver electrode film as a bus electrode is formed on a wide transparent electrode film made of an electrically conductive metal oxide such as ITO, $SnO_2$, or ZnO as shown in FIG. 2B.

To provide a wide discharge area within a cell, it is more preferable to employ the wide transparent electrode to form the display electrode. On the other hand, the display electrode formed simply from the silver electrode film is easier to manufacture. Also, when the PDP has a minute cell construction, the width of each display electrode needs to be set small, for example, at 50 $\mu$m or smaller. In such a case, the display electrode formed simply from the silver electrode film is more suitable.

The transparent dielectric layer 13 is a layer made of a dielectric material which is arranged so as to cover the entire surface of the front glass substrate 11 on which the display electrodes 12 are arranged. Lead glass with a low melting point is typically used for this purpose, but bismuth glass with a low melting point or a laminate of these two types of glass may also be used.

The protective layer 14 is a thin film made of MgO covering the entire surface of the transparent dielectric layer 13.

In the back panel 20, the address electrodes 22 are formed from a silver electrode film.

The white dielectric layer 23 is formed from the same material as the transparent dielectric layer 13, but the white dielectric layer 23 also includes $TiO_2$ particles so that it functions as a visible light reflective layer as well.

The barrier ribs 30 are made of a glass material and project out on the white dielectric layer 23 in the back panel 20.

The following are the phosphors used to compose the phosphor layers 31 in the present embodiment:

blue phosphor $BaMgAl_{10}O_{17}$: Eu
green phosphor $Zn_2SiO_4$: Mn
red phosphor (Y, Gd) $BO_3$: Eu The PDP is constructed by connecting a driving circuit (not illustrated) to the display electrodes 12 and the address electrodes 22. The driving circuit applies an address discharge pulse to the scanning electrodes 12*a* and the address electrodes 22, so that wall charge accumulates in the cells that are to be ignited. Following this, a sustaining discharge pulse is applied between the pairs of the display electrodes 12*a* and 12*b* so that sustained discharge occurs in the cells that have accumulated wall charges. The above process is repeated to ignite the cells and produce a luminescent display.

[Manufacturing Method for the PDP]

The following is an explanation of a manufacturing method for the PDP with the above construction.

(Manufacturing the Front Panel)

The display electrodes 12 are formed by first forming transparent electrodes on the front glass substrate 11 if necessary, applying a paste for silver electrodes onto the front glass substrate 11 using the screen-printing method, and baking the applied paste. The silver paste used here will be explained in detail later.

The transparent dielectric layer 13 is then formed by applying a paste containing glass powder with a melting point of 600° C. or lower (the glass powder is composed for example of PbO 70 wt %, $B_2O_3$ 15 wt %, and $SiO_2$ 15 wt %) using the die coat method or the screen-printing method so as to cover the display electrodes 12, and baking the applied paste.

To form the transparent dielectric layer 13 using the die coat method, glass for a dielectric material is first ground with a jet mill until the average particle diameter becomes 1.5 $\mu$m. Following this, (a) 35 to 70 wt % of the ground glass powder and (b) 30 to 65 wt % of a binder material made of terpineol containing 5 to 15 wt % of ethyl cellulose, butyl carbitol acetate, or pentanediol, are thoroughly kneaded with the jet mil to prepare a paste for die-coat. Note that approximately 0.1 to 3.0 wt % of anionic surfactant may be added to the paste during kneading for the purpose of improving the dispersibility of the glass powder and helping prevent the glass powder from precipitating.

The viscosity of the paste is adjusted to 300,000 centipoises or less, and is applied. The applied paste is dried, and baked at a temperature (in a range of 550 to 590°C.) that is slightly higher than the softening point of the glass.

On the surface of the transparent dielectric layer 13 formed in this way, the MgO protective layer 14 is formed using the sputtering method or the like.

(Manufacturing the Back Panel)

The address electrodes 22 are formed by applying a paste for silver electrodes onto the back glass substrate 21 by screen-printing and baking the applied paste. The white dielectric layer 23 is formed by applying a paste containing $TiO_2$ particles (with the average particle diameter of 0.1 to 0.5 $\mu$m) and dielectric glass particles (with the average particle diameter of 1.5 $\mu$m) onto the address-electrodes 22 using the screen-printing method and baking the applied paste. The barrier ribs 30 are formed by repeatedly applying a paste containing glass particles to the white dielectric layer 23 using the screen-printing method, then baking the applied paste or using a sand-blasting method.

The phosphor pastes (or phosphor inks) of red, green, and blue are respectively prepared and applied to the spaces between the barrier ribs 30. The phosphor layers 31 are formed by baking the applied pastes in air (for example, at the temperature of 500° C. for 10 minutes).

The phosphor pastes are applied to the spaces typically using the screen-printing method. However, when the panel construction is minute, it is preferable to use a method in which phosphor ink of around 1.0 Pas is spouted from a nozzle which is being scanned over the panel (a ink jet method) to allow the phosphor pastes to be applied precisely and uniformly.

The phosphor layers 31 of respective colors can also be formed with the following method. Sheets of photosensitive resin including phosphor materials of respective colors are prepared, and attached to the surface of the back glass substrate 21 on which the barrier ribs 30 are arranged. The sheets are then patterned and developed by photolithography to remove unnecessary components.

(Sealing Front and Back Panels)

Sealing glass (a sealing glass frit) is applied to one or both of the front panel 10 and the back panel 20 that have been manufactured as described above, and the applied sealing glass is pre-baked to form a glass sealant layer. The front panel 10 and the back panel 20 are then put together with the display electrodes 12 and the address electrodes 22 facing each other at right angles. Both panels 10 and 20 are then heated, softening the glass sealant layer and sealing them together.

The panels sealed as described above are baked while air is being removed from the inner space between the sealed panels to produce a high vacuum ($1.1\times10^{-4}$ Pa($8\times10^{-7}$Torr)). The discharge gas is then introduced into the space to complete the PDP.

(Characteristics and Manufacturing Methods of the Display Electrodes 12 and the Address Electrodes 22)

As described above, the display electrodes 12 are constructed of a laminate of the thin silver electrode film as a bus electrode and the transparent electrode film formed thereon, or are constructed of the sliver electrode film. The display electrodes 12 are characterized by this silver electrode film.

More specifically, a conventional typical silver electrode is made by baking a mixture of Ag particles and a glass material. However, the silver electrode film employed in the present embodiment has either of the following characteristics (1) and (2).

(1) The silver electrode film is made of an Ag alloy that is mainly composed of Ag and containing a transition metal (at least one selected from the group consisting of Cu, Co, Ni, Cr, Mn, and Fe).

This silver electrode film made of the Ag alloy can be formed either using the thin-film forming method, or using the thick-film forming method.

The silver electrode film can be formed using the thin-film forming method as follows. The Ag alloy is formed into a film using the thin-film forming method (the sputtering method), and the film is patterned as stripes using the photolithography method.

FIGS. 4A to 4E are for explaining this method for forming the sliver electrode film made of the Ag alloy.

Figure 4A:
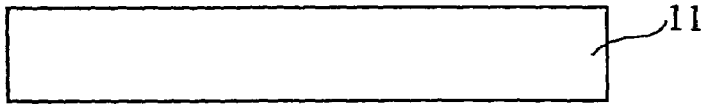
FIGS. 4A to 4E are for explaining a method for forming a silver electrode film made of an Ag alloy using a sputtering method.
Figure 4B:
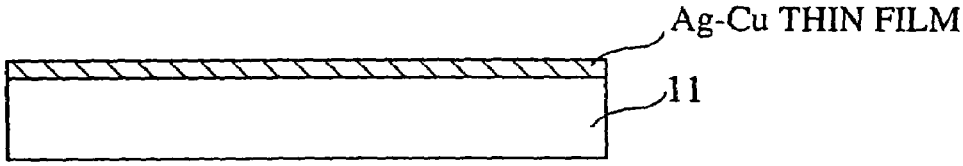

An alloy made of Ag and a transition metal (for example, an Ag—Cu alloy) is used to form a silver electrode film on the entire surface of the front glass substrate 11 with the sputtering method (FIGS. 4A and 4B).

Figure 4C:
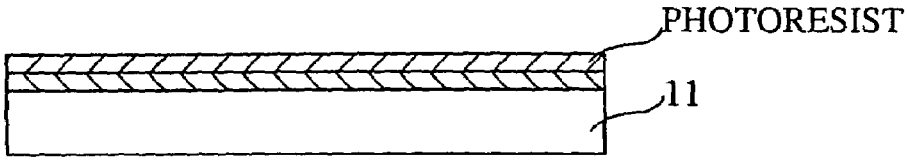
Figure 4D:
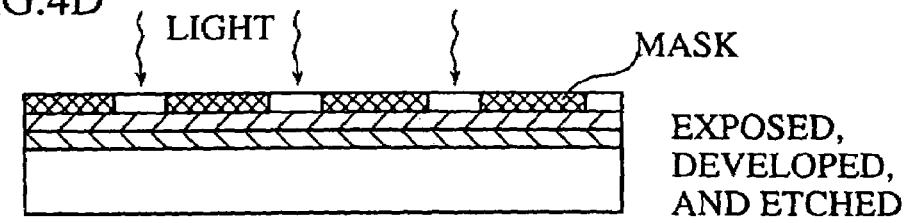
Figure 4E:
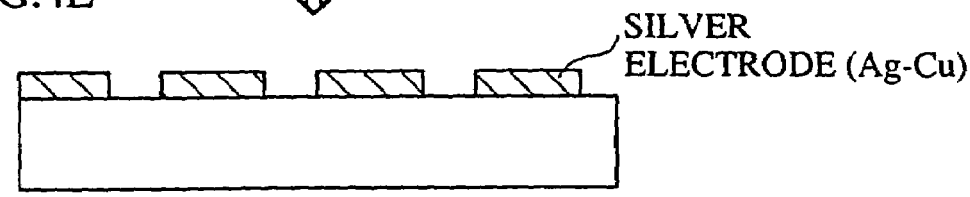

Following this, photoresist is applied to the entire surface of the silver electrode film (FIG. 4C). The applied photoresist is exposed, with regions where electrodes are to be formed being covered with pattern masks (FIG. 4D), and then developed to remove the exposed parts of the photoresist. Here, the silver electrode film is etched to form the silver electrode film in stripes.

In this way, the silver electrodes each constructed of a minute thin film made of the Ag alloy are formed.

The following describes the case where the silver electrode film made of an Ag alloy is formed using the thick-film forming method, with reference to FIGS. 5A to 5E and FIGS. 6A to 6D.

Figure 5A:
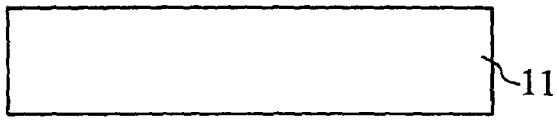
FIGS. 5A to 5E are for explaining a method for forming a silver electrode film made of an Ag alloy using a thick-film forming method.
Figure 5B:
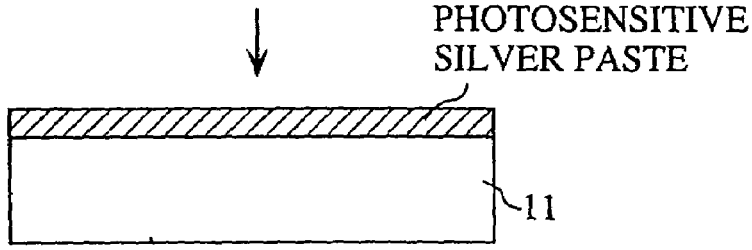
Figure 5C:
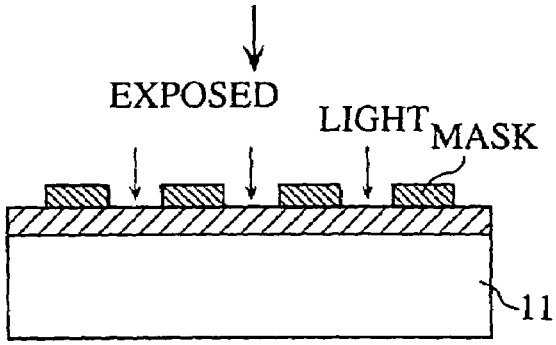
Figure 5D:
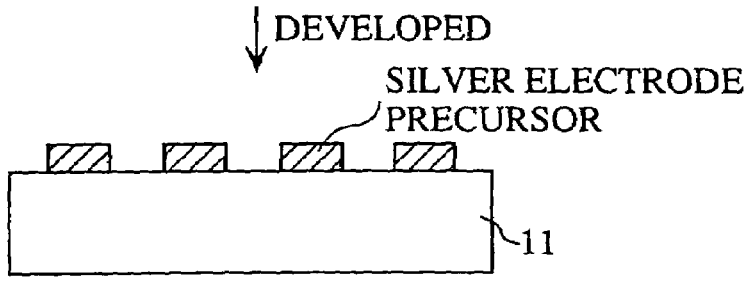
Figure 5E:
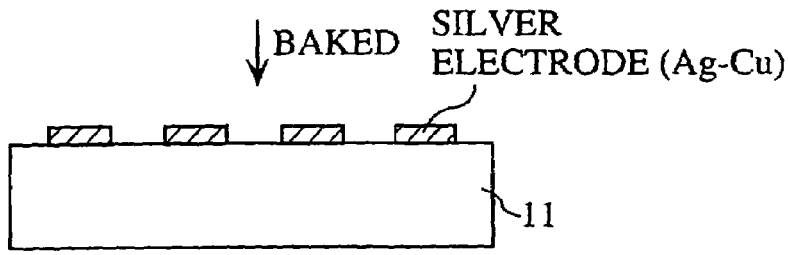

As shown in FIGS. 5A to 5E, a photosensitive silver paste (or a photosensitive silver film) including particles of an alloy of Ag and a transition metal (for example, Ag—Cu alloy particles), a glass frit, photosensitive resin, and the like, is applied to the entire surface of the front glass substrate 11 (FIG. 5B). The applied paste is then patterned as stripes using the photolithography method described above (or using a lift-off method) (FIG. 5C), to form silver electrode precursors (FIG. 5D). The silver electrode precursors are then baked to form the silver electrodes (FIG. 5E).

Figure 6A:
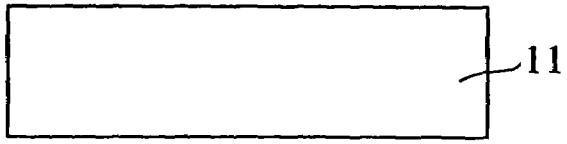
FIGS. 6A to 6D are for explaining a method for forming a silver electrode film made of an Ag alloy using the thick-film forming method.
Figure 6B:
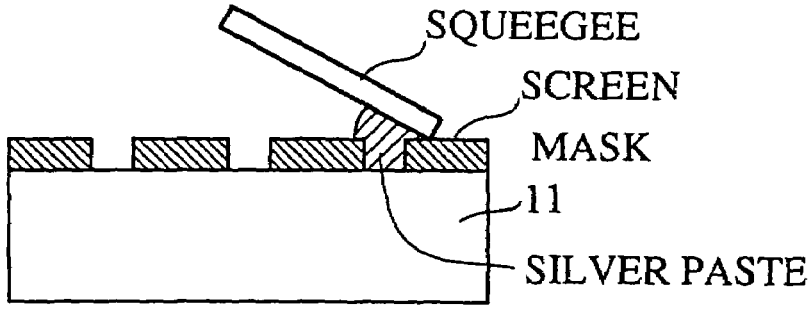
Figure 6C:
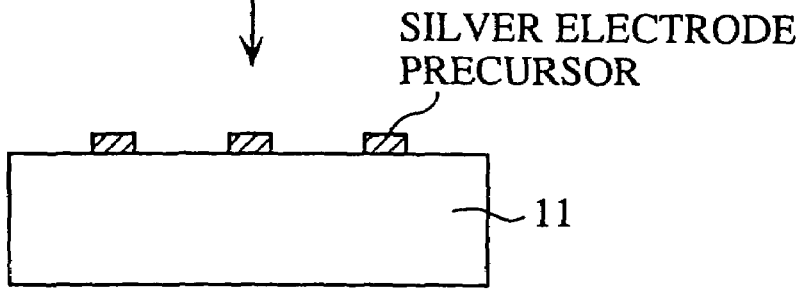
Figure 6D:
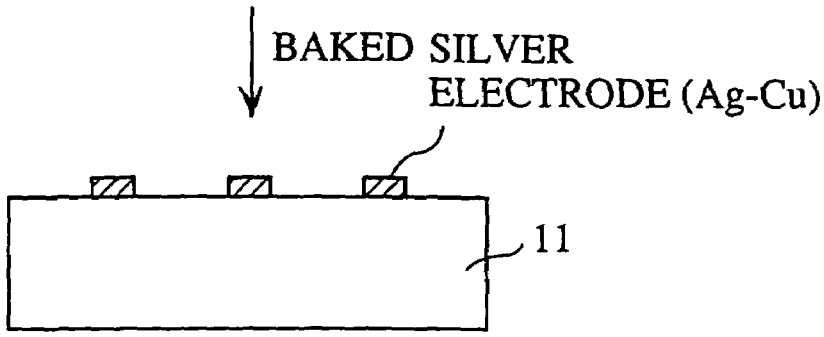

Another method to form the silver electrodes is described in FIGS. 6A to 6D. With this method, a silver paste for printing including Ag alloy particles and a glass frit is applied as strips to the surface of the front glass substrate 11 using the screen-printing method (FIG. 6B), to form silver electrode precursors (FIG. 6C). The silver electrode precursors are then baked to from the silver electrodes (FIG. 6D).

Figure 7A:
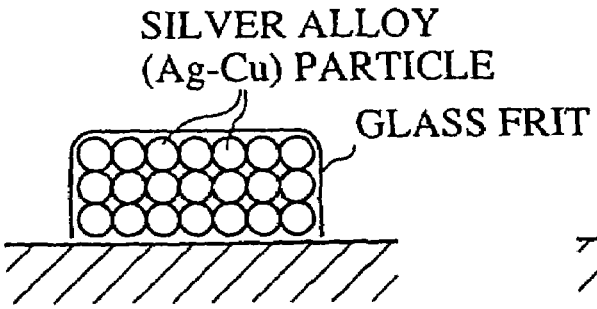
FIGS. 7A and 7B each show a construction of a silver electrode formed using the thick-film forming method.

The silver electrodes formed using the thick-film forming method as described above each have such a construction in which the Ag alloy particles are sintered with the glass frit as shown in FIG. 7A.

(2) The silver electrode film is formed by sintering Ag particles with glass containing a transition metal oxide (at least one selected form the group consisting of CuO, $Cr_2O_3$, NiO, $Mn_2O_3$, $CO_2O_3$, and $Fe_2O_3$).

This silver electrode film can be formed using a silver paste or a silver film containing Ag particles and a glass frit to which a transition metal oxide is added, with the thick-film forming method described in the above characteristic (1), with reference to FIGS. 5A to 5E and FIGS. 6A to 6D.

To add the transition metal oxide to the glass frit, the transition metal oxide may be contained in the composition of the glass frit, or powder of the transition metal oxide may be mixed with powder of the glass frit.

Figure 7B:
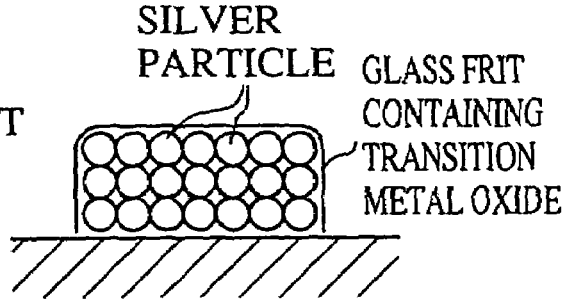

In either case, the sintered silver electrodes each have such a construction in which Ag particles are sintered with the glass frit containing the transition metal oxide as shown in FIG. 7B.

To form laminate-type electrodes that are each constructed of a laminate of the silver electrode film and the transparent electrode film formed thereon, the silver electrodes can be formed using either of the above described methods after forming the transparent electrode film.

When the transparent dielectric layer 13 is formed on the display electrodes 12 as described above, they are closely bond with each other.

It should be noted here that the address electrodes 22 also have the same characteristics (1) and (2) as the display electrodes 12.

(Effects Produced by the Present Embodiment)

In the PDP of the present embodiment, the yellowing is effectively prevented, in comparison with a PDP provided with conventional silver electrodes.

The reasons for this can be considered as follows.

Figure 3:
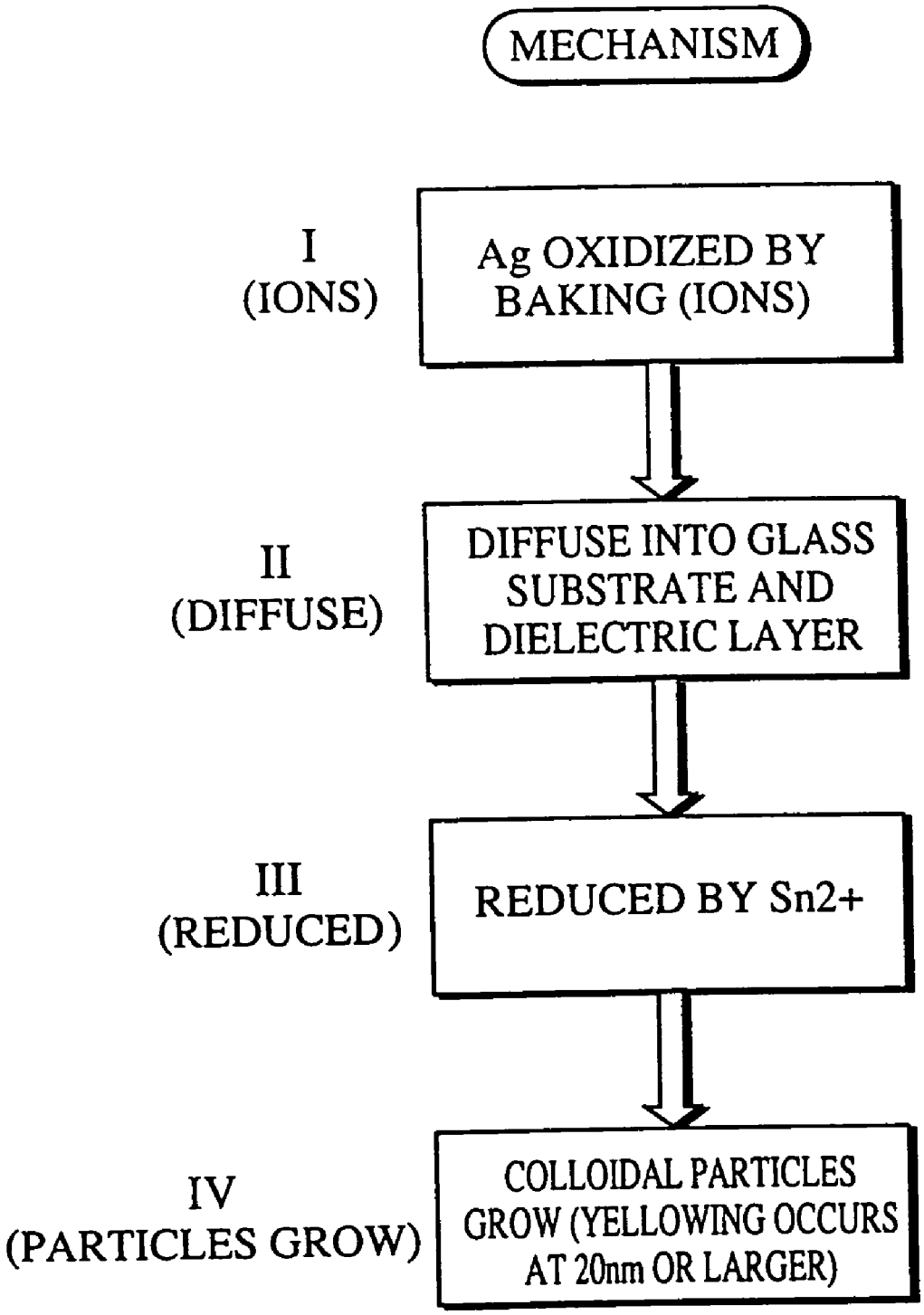
FIG. 3 is for explaining a mechanism that causes yellowing of a panel.

In a conventional silver electrode, Ag ions are likely to diffuse into the glass substrate and in the dielectric layer when the electrode and the glass substrate are baked as-shown in (II) in FIG. 3. However, the silver electrode in the present invention contains a transition metal such as Cu, Cr, Co, Ni, Mn, or Fe, or an oxide of such a transition metal. The transition metal or the transition metal oxide can effectively prevent Ag ions from diffusing.

Also, the transition metal or the transition metal oxide possess the property of coloring glass with a green to blue color. Since the green to blue color is complementary to a yellow color, this coloring has the effect of offsetting the yellowing due to Ag colloids (that is the effect of shifting "b" value of the color difference in the L*a*b colorimetric system to the negative direction).

The transition metal content in the Ag alloy is preferably set at 5 wt % or more, for achieving sufficient effect to prevent the yellowing. The transition metal oxide content in the glass frit is also preferably set at 5 wt % or more.

If the ratio of the transition metal element in the Ag alloy is too high, the resistance value of the silver electrode tends to become high. Therefore, to ensure the conductivity of the silver electrode, it is preferable to set the transition metal content in the Ag alloy at 20 wt % or less. Also, when the ratio of the transition metal element in the Ag alloy is too high, the light transmission rate of the panel tends to decrease due to coloring of the panel by the transition metal. In view of this, it is preferable to set the transition metal content in the Ag alloy at 20 wt % or less.

Also, when the ratio of the transmission metal oxide content in the glass frit is too high, the light transmission rate of the panel tends to decrease due to the coloring of the plate by the transition metal. Therefore, the transmission metal oxide content in the glass frit should also be set at 20 wt % or less.

Note that in the present embodiment, a transition metal or a transition metal oxide can be freely chosen from the several transition metals and the transition metal oxides listed above, taking the manufacturing conditions of the PDP or the accessibility of the materials into account. In this point, too, the present embodiment provides high values in practical use.

EXAMPLE 1

PDPs of No. 1 to No. 12 shown in Table 1 are preferred examples in which the display electrodes (the first electrodes) and the address electrodes (the second electrodes) were formed using an Ag alloy of Ag and a transition metal (selected from Cu, Co, Ni, Mn, and Fe) with the sputtering method and the photolithography method.

PDPs of No. 14 to No. 25 shown in Table 2 and PDPs of No. 27 to No. 38 shown in Table 3, and PDPs of No. 40 to No. 51 shown in Table 4 are preferred examples in which the display electrodes (the first electrode) and the address electrodes (the second electrodes) were formed using an Ag paste made of a glass frit of PbO—$B_2O_3$—$SiO_2$ to which a transition metal oxide (selected from CuO, CoO, NiO, and $Cr_2O_3$, MnO, $Fe_2O_3$) was added.

Among these, for the PDPs of No. 14 to No. 25 in Table 2, a photosensitive silver paste made of (a) Ag particles, (b) a PbO—$B_2O_3$—$SiO_2$—MO glass frit (MO being made of a transition metal oxide), and (c) a photosensitive organic material (made of photosensitive monomer, photosensitive polymer, photopolymerization initiator, sensitizer, and organic solvent) was patterned using the photolithography method, and the patterned paste was baked at the temperature of 550° C. to form the silver electrodes.

For the PDPs of No. 27 to No. 38 in Table 3, an Ag paste for printing made of (a) Ag particles, (b) a $Bi_2O_3$—$B_2O_3$—$SiO_2$—MO glass frit (MO being made of a transition metal oxide), and (c) an organic vehicle (made of ethyl cellulose, butyl carbitol acetate, and terpineol) was applied using the screen-printing method, and the applied paste was baked at the temperature of 550° C. to form the silver electrodes.

For the PDPs of No. 40 to No. 51 in. Table 4, an indium oxide-tin oxide (ITO) film was formed using the sputtering method, and the film was patterned using the photolithography method to form wide ITO transparent electrodes. A photosensitive silver paste was then applied onto each of the ITO transparent electrodes, and was patterned and baked at the temperature of 550° C. to form the silver electrodes. In this way, the display electrodes (the first electrodes) were formed.

These PDPs each were manufactured using the following specifications.

Assuming a display for use in a 42-inch VGA, the cell size was set as follows. The barrier ribs 30 were set at 0.15 mm in height, having the space (cell pitch) of 0.36 mm between adjacent barrier ribs 30.

The electrode distance "d" of the display electrode pair was set at 0.10 mm, and the width of the silver electrode was set at 100 $\mu$m. When providing the transparent electrode, its width was set at 150 $\mu$m.

As a discharge gas, a mixed gas of Ne and Xe (5 wt %) was introduced with the charging pressure of 80000 Pa(600 Torr).

The transparent dielectric layer 13 was formed by applying PLS-3244 (PbO—$B_2O_3$—$SiO_3$—CaO glass) manufactured by NIPPON ELECTRIC GLASS CO., LTD. using the die-coat method or the screen-printing method, and baking the applied glass, so that the thickness of the transparent dielectric layer 13 was made 30 to 40 $\mu$m.

The MgO protective layer 14 was formed using the sputtering method, so that the thickness was made 1.0 $\mu$m.

The white dielectric layer 23 on the back panel was formed by applying the same glass as used for the transparent dielectric layer 13 to which $TiO_2$ was added, using the die-coat method, and baking the applied glass.

PDPs of No. 13, No. 26, No. 39, and No. 52 are comparative examples, and were manufactured using the same specifications as the PDPs of No. 1 to No. 12, No. 14 to No. 25, No. 27 to No. 38, and No. 40 to No. 51, except that a transition metal is included neither in the Ag particles nor in the glass frit for the PDPs of the comparative examples.

(Experiment 1)

For the front panels 10 of the PDPs of No. 1 to No. 52, the "a" value and the "b" value (JIS Z8730 color difference presentation method) were measured with the colour-difference meter (NIPPON DENSHOKU CO., LTD. Item No. NF777).

The "a" value and "b" value are indicators of the coloring degree and the coloring tendency of the front panel 10. The larger the "a" value in the positive direction, the stronger the red coloring. The larger the "a" value in the negative direction, the stronger the green coloring. On the other hand, the larger the "b" value in the positive direction, the stronger the yellow coloring. The larger the "b" value in the negative direction, the stronger the blue coloring.

When the "a" value is in a range of −5 to +5 and the "b" value is in a range of −5 to +5, the coloring of the glass substrate (yellowing) is hardly visible. However, when the "b" value exceeds 10, the yellowing distinctively becomes visible.

Also, for the PDPs of No. 1 to No. 52, the color temperature of the full-white images was measured with a multichannel spectrometer (MCPD-7000 by OTSUKA ELECTRONICS CO., LTD.).

The experimental results are shown in Tables 1 to 4.

(Considerations)

For the PDPs No. 13, No. 26, No. 39, and No. 52 of the comparative examples, the "b" value ranges from +14 to +16.2. This indicates that severe yellowing is occurring. On the other hand, for the PDPs No. 1 to No. 12, No. 14 to No. 25, No. 27 to No. 38, and No. 40 to No. 51, the "b" value ranges from as low as 0 to +4.5. This indicates that these PDPs are superior with less yellowing.

Also, for the PDPs of the comparative examples, the color temperature ranges from 6290 to 6500° K. On the other hand, for the PDPs of the preferred examples, the color temperature ranges from as high as 8300 to 9200° K. This indicates that the PDPs of the preferred examples exhibit improved color reproduction and thereby enables more vivid display, compared with the PDPs of the comparative examples.

Note that when $Bi_2O_3$ glass or ZnO glass was used to form the transparent dielectric layer instead of PbO glass used above, the similar results were obtained.

Second Embodiment

A PDP relating to the present embodiment has the same construction as in the first embodiment, with the only difference being in a type of metal added to the silver electrodes. In the present embodiment, platinum group metals, Re, or their oxides are added to the silver electrodes.

In the present embodiment, the display electrodes 12 and the address electrodes 22 use (1) the silver electrode film made of an Ag alloy that is mainly composed of Ag and containing a metal (at least one selected from the group consisting of Ru, Rh, Ir, Os, and Re). Alternatively, the display electrodes 12 and the address electrodes 22 use (2) the silver electrode film made by sintering Ag particles with glass containing a metal oxide (at least one selected form the group consisting of $RuO_2$, RhO, $IrO_2$, $OsO_2$, $ReO_2$, and PdO).

The above silver electrode film (1) can be formed using either the thin-film forming method or the thick-film forming method, and the above silver electrode film (2) can-be formed using the thick-film forming method. These forming methods are the same as described in the first embodiment.

As described above, a metal (at least one selected form the group consisting of Ru, Rh, Ir, Os, and Re) or a metal oxide (at least one selected from the group consisting of $RuO_2$, RhO, $IrO_2$, $OsO_2$, $ReO_2$, and PdO) added to the silver electrodes can effectively prevent the yellowing of the panel. The reason for this is that the above metals (mainly the platinum group metals) or their oxides have the pinning effect, which makes Ag ions less likely to diffuse into the substrate and into the dielectric layer during baking of the electrodes or baking of the dielectric layer. Also, due to the pinning effect, Ag ions become less likely to be reduced (that is, steps II and III are impeded). This prevents Ag colloidal particles from growing, and accordingly prevents the yellowing.

The content of a metal (Ru, Rh, Ir, Os, or Re) in the Ag alloy and the content of a metal oxide in the glass frit are preferably set in a range of 5 to 20 wt % inclusive for the same reason as in the first embodiment.

Also, in the present embodiment, a metal or a metal oxide to be added to Ag can be freely chosen from the several metals and the metal oxides listed above, taking the manufacturing conditions of the PDP or the accessibility of the materials into account. In this point, too, the present embodiment provides high values in practical use.

(Simultaneous Baking of the Silver Electrode Precursors and the Dielectric Layer Precursor)

When forming the silver electrode film using the thick-film forming method, the simultaneous baking of the silver electrode precursors and the dielectric layer precursor, which will be described as follows, is more effective in preventing the yellowing.

FIGS. 8A to 8D are steps for explaining a simultaneous baking method of the silver electrode precursors and the dielectric layer precursor.

Step 1: Silver Electrode Precursor Forming Step

Figure 8A:
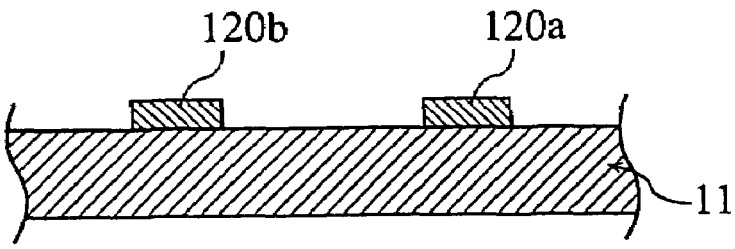
FIGS. 8A to 8D show steps for explaining a simultaneous baking method of silver electrode precursors and a dielectric layer precursor.

The silver electrode precursors 120*a* and 120*b* are formed as stripes on the front glass substrate 11 using an Ag paste or a silver electrode film as shown in FIG. 8A.

It is preferable to use a cellulose compound such as ethyl cellulose, or acrylic polymer such as methyl methacrylate as an organic binder to be included in the silver electrode paste. However, other materials may also be used for this purpose.

When using an Ag paste, the Ag paste can be applied as electrode patterns using the screen-printing method and the applied paste is dried. Alternatively, the Ag paste can be applied to the front glass substrate 11 all over using the screen-printing method or the die coat method, dried, and-then patterned using the photolithography method (or using the lift-off method).

The silver electrode film is formed by processing the same material as the Ag paste into a film using a blade method or the like. When using this silver electrode film, it can be applied to the front glass substrate 11 all over, and then patterned using the photolithography method (or using the lift-off method).

Step 2: Dielectric Layer Precursor Forming Step

Figure 8B:
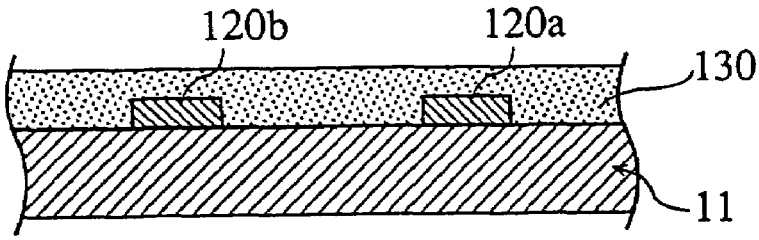

The dielectric precursor layer 130 is formed so as to cover the silver electrode precursors 120*a* and 120*b* formed as the electrode patterns (FIG. 8B).

This dielectric layer precursor 130 is formed by applying a dielectric paste composed of glass and an organic binder as its essential components, to which a solvent is added, using the screen-printing method or the die coat method, and then drying the applied paste. Alternatively, the dielectric layer precursor 130 may be formed by laminating a dielectric film using the lamination method, the dielectric film being made by processing the above essential components into a film.

Step 3: Resin Decomposing Step

Figure 8C:
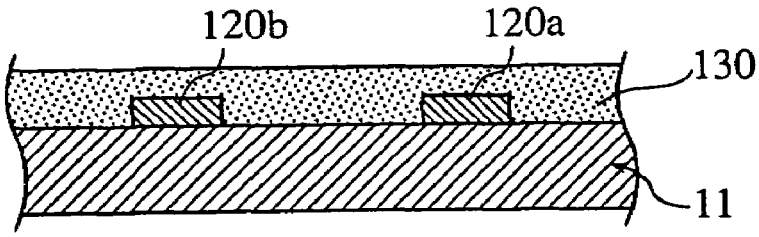

The silver electrode precursors 120*a* and 120*b* and the dielectric layer precursor 130 are heated in a furnace to the temperature at which resin included therein decomposes, so that the resin is burned out. Here, it is preferable to-completely decompose the resin contained in the dielectric layer precursor 130 by adjusting the temperature rising speed to be slow, or ceasing to rise the temperature, at temperatures higher than the temperature at which the resin starts decomposing (FIG. 8C).

Also, in this step, an oxidizing gas such as oxygen may be introduced to accelerate oxidization, or a reducing gas such as hydrogen may be introduced to prevent metals or the like from being oxidized.

To accelerate oxidization at lower cost, gas generated along with oxidization of the resin may be removed promptly by introducing a dry air or by reducing pressure of a heating atmosphere.

Step 4: Baking Step

Following the heating step, the silver electrode precursors 120*a* and 120*b* and the dielectric layer precursor 130 are further heated up, so that glass materials included in the silver electrode precursors 120*a* and 120*b* and a glass material included in the dielectric layer precursor 130 are softened. Left at temperatures higher than the softening point of these glass materials for several minutes to several tens minutes, these glass materials are sintered.

Figure 8D:
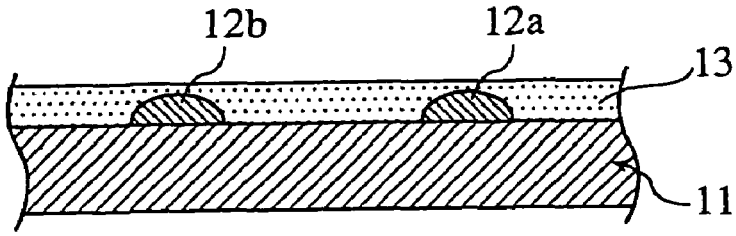

Following the baking step, the silver electrode precursors 120*a* and 120*b* and the dielectric layer precursor 130 are further heated up, to form the electrodes 12*a* and 12*b* and the transparent dielectric layer 13 (FIG. 8D).

(Effects Produced by the Simultaneous Baking of the Silver Electrode Precursors and the Dielectric Layer Precursor)

Conventionally, a typical method to form silver electrodes on a glass substrate is to form silver electrode precursors on the glass substrate first, and then bake the formed silver electrode precursors. However, in this case, the silver electrode precursors are baked in a state of being uncovered. Therefore, Ag ions are more likely to diffuse onto the glass substrate.

Since a reducing material such as Sn exists around the surface of the glass substrate, the diffused Ag ions are reduced to Ag, generating Ag colloids. Due to these Ag colloids, the glass substrate is likely to yellow.

On the contrary, when the silver electrode precursors and the dielectric layer precursor are baked simultaneously as describe above, the silver electrode precursors are covered with the dielectric layer precursor when baked. This decreases the number of Ag ions to diffuse onto the glass substrate.

Here, Ag ions also diffuse into the dielectric layer precursor. However, the amount of the reducing material included in the dielectric layer precursor is smaller than that around the surface of the glass substrate, a chance of these diffused Ag ions being reduced is low.

Therefore, the simultaneous baking of the silver electrode precursors and the dielectric layer precursor results in decreasing the total number of Ag colloids to be generated, and thereby preventing the yellowing.

EXAMPLE 2

PDPs of No. 61 to No. 72 shown in Table 5 are preferred examples in which the display electrodes (the first electrodes) and the address electrodes (the second electrodes) were formed using an Ag alloy of Ag and a metal (at least one selected from the group consisting of Ru, Rh, Ir, Os, Pd, and Re) based on the second embodiment. Note that the PDP of No. 66 is a reference example in which Ag—Pd alloy powder was used.

The front panels of the PDPs of No. 61 to No. 72 were manufactured in the following way.

(a) Ag alloy powder, (b) an organic vehicle mainly composed of ethyl cellulose, butyl carbitol acetate, and terpineol, and (c) a glass frit mainly composed of $Bi_2O_3$—$B_2O_3$—$SiO_2$ were kneaded at a predetermined weight ratio, and patterned to form the electrode precursors using the screen-printing method.

Following this, a glass paste for a dielectric material (PbO—$B_2O_3$—$SiO_2$—CaO glass, $Bi_2O_3$—ZnO—$SiO_2$ glass, or ZnO—$B_2O_3$—$SiO_2$—$K_2O$ glass as shown in FIG. 5) was applied so as cover the electrode precursors and formed so as to be 30 $\mu$m in thickness using the printing method.

The electrode precursors and the dielectric layer precursor were then heated and baked at the temperature of 590° C., to complete the front panel.

The PDPs of No. 74 to No. 85 shown in Table 6 are preferred examples in which the display electrodes (the first electrodes) and the address electrodes (the second electrodes) were formed using a glass frit including $RuO_2$, $ReO_2$, $IrO_2$, RhO, $OsO_2$, or PdO based on the second embodiment.

For the PDPs of No. 74 to No. 85, a photosensitive Ag paste (a photo Ag paste) was used to form the silver electrodes with the photolithography method. A glass frit in the photosensitive Ag paste was prepared by adding 5 wt % of $RuO_2$, $ReO_2$, $IrO_2$, RhO, $OsO_2$, or PdO to powder of one of PbO—$B_2O_3$—$SiO_2$ glass, $Bi_2O_3$—$B_2O_3$—$SiO_2$ glass, and $P_2O_5$—$B_2O_3$—$SiO_2$ glass. For the other PDPs, the front panel was formed in the same way as for the PDPs of No. 61 to No. 72.

The PDPs of No. 73 and No. 86 are comparative examples, in which Ag particles do not include Ru, Re, Ir, Rh, and Os, and the glass frit does not include $RuO_2$, $ReO_2$, $IrO_2$, RhO, and $OsO_2$.

For the PDPs of No. 61 to No. 86 shown in Tables 5 and 6, the same specifications as in the first embodiment were used as to the cell size, the dielectric layer, the protective layer, and the discharge gas.

(Experiment 2)

For the front panels 10 of the PDPs of No. 61 to No. 86, the "a" value and the "b" value were measured in the same manner as in Experiment 1. Also, for the PDPs of No. 61 to No. 86, the color temperature of the full-white images was measured.

The experimental results are shown in Tables 5 and 6.

(Considerations)

For the PDPs No. 73 and No. 86 of the comparative examples, the "b" value fairly exceeds 10. This indicates that severe yellowing is occurring. On the other hand, for the PDPs No. 61 to No. 72, and No. 74 to No. 85, the "b" value ranges from as low as 0 to +4.0. This indicates that these PDPs are superior with less yellowing.

Also, for the PDPs of the comparative examples, the color temperature is below 6500° K. On the other hand, for the PDPs of the preferred examples and the reference example, the color temperature ranges from as high as 8300 to 9200° K.

Also, for the PDP of No. 66 of the reference example, the "b" value is much smaller than that for the PDP of No. 73 of the comparative example, but is slightly larger than those for the PDPs of No. 61 to No. 65, and No. 67 to No. 71 of the preferred examples.

Third Embodiment

A PDP relating to the present embodiment has the same construction as in the first embodiment, with the only difference being in the following point. In the present embodiment, Ag particles whose surfaces are each coated with a metal or a metal oxide are used to form a silver electrode film when forming the display electrodes 12 and the address electrodes 22.

Here, metals preferably used to coat the surfaces of the Ag particles are Pb, Cu, Ni, Co, Cr, Rh, Ir, and Ru. Metal oxides preferably used to coat the surfaces of the Ag particles are $Al_2O_3$, NiO, $ZrO_2$, CoO, $Fe_2O_3$, ZnO, $In_2O_3$, CuO, $TiO_2$, and $Pr_6O_{11}$, and $SiO_2$.

The following describes a method for forming such a silver electrode film.

First, Ag particles are each coated with the above metal or the above metal oxide. The following describes three methods (1) the electroless plating method, (2) the mechanofusion method, and (3) the sol-gel method that can be employed as the coating method.

Figure 9A:
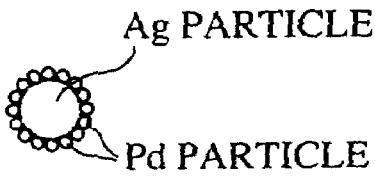
FIGS. 9A to 9D are each for explaining a silver electrode formed by coating the surface of an Ag particle with a metal or a metal oxide.
Figure 9B:
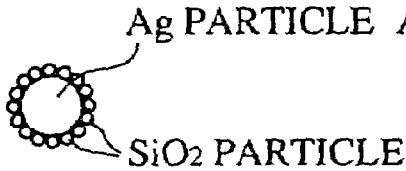

(1) Electroless Plating Method:

As one example, to have Pd particles adhere to the surfaces of Ag particles, the Ag particles are put into a palladium chloride ($PbCl_2$) solution, and the solution is stirred, so that Pd particles are adhered to each Ag particle as illustrated in FIG. 9A.

To have other metals such as Cu, Ni, Co, Cr, Rh, Ir, and Ru adhere to Ag particles, too, their solutions are first prepared, and the Ag particles are put into the respective solutions, stirred, and so these metals can be adhered to the Ag particles. In this case, a good way to increase adherence of the metals such as Cu, Ni, Co, Cr, Ir, and Ru to the Ag particles is to first use a palladium chloride solution for making the Pd particles adhere to the Ag particles, and then make these metals to adhere to the Ag particles.

(2) Mechanofusion Method:

Metal oxide powder or metal powder is mixed with Ag powder. To this mixture, mechanical energy is applied, causing mechanochemical reaction on the surfaces of the Ag particles. In this way, the metal oxide powder or the metal powder is adhered to the Ag particles.

With this mechanofusion method, a metal oxide layer can be formed by making the metal oxide adhere to the surface of each Ag particle, and also, a metal layer can be formed by making metal particles adhere to the surface of each Ag particle.

To be more specific, Ag powder and powder of the above metal oxide (for example, $SiO_2$ with the average particle diameter of 0.1 $\mu$m) are prepared. Here, it is preferable to use spherical Ag particles.

The prepared Ag powder and the metal oxide powder are processed with a mechanofusion device (for example, with the mechanofusion device AMS manufactured by HOSOKAWA MICRON). Due to this, the metal oxide particles that are child particles are fused with the surface of each Ag particle that is a mother particle, so that the mother particle is coated with the child particles.

(3) Sol-Gel Method:

Ag particles and alkoxide of a metal oxide are put into an alcohol solution. The metal alkoxide is hydrolyzed, so that the metal oxide is adhered to the Ag particles.

Figure 9C:
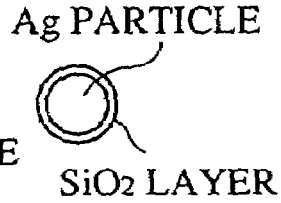

To be more specific, Ag powder and metal alkoxide $M.(O.R)_n$ (note that "M" denotes metal, "O" denotes oxygen, "R" denotes alkoxy, and "n" denotes an integer, for example, $Si(OC_2H_5)_4$)) are put into an alcohol solution. The metal alkoxide is hydrolyzed, so that the metal oxide layer ($SiO_2$ layer) is formed on the surface of each Ag particle as shown in FIG. 9C.

As described above, the silver electrodes are formed using Ag particles whose surfaces are each coated with a metal or a metal oxide. Here, the photosensitive paste (or photosensitive silver film) maybe prepared as explained in FIG. 5 in the first embodiment and the silver electrodes may be formed using the photolithography method (or using the lift-off method), or the silver paste for printing may be prepared as explained in FIG. 6 in the first embodiment, and the silver electrode may be formed using the screen-printing method.

Figure 9D:
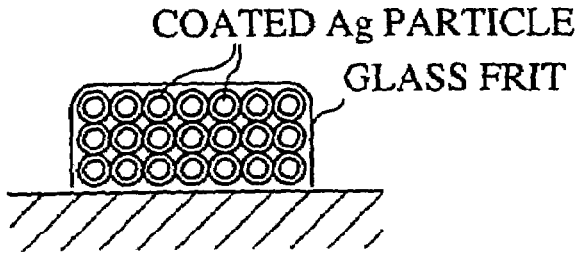

The silver electrodes formed as described above each have such a construction as shown in FIG. 9D in which Ag particles each covered with a metal or a metal oxide layer are sintered with the glass frit.

(Effects Produced by the Present Embodiment)

In the present embodiment, the surfaces of Ag particles used for forming the silver electrodes are each coated with a metal or a metal oxide. Accordingly, Ag ions are less likely to diffuse around form the Ag particles. This prevents Ag colloids from being generated on the surface of the glass substrate and in the dielectric layer in the electrode baking step as well as in the dielectric layer baking step.

Also, since the above metals and the metal oxides are the same as the transition metals and the transition metal oxides used in the first embodiment, and also as the metals and the metal oxides used in the second embodiment, they can produce the yellowing preventing effect due to the complementary colors of the transition metals (the transition metal oxides) and the Ag ions dispersion preventing effect (impeding step II in FIG. 3) descried in the first embodiment, and the Ag ion reducing preventing effect due to the metals (the metal oxides) (impeding step III in FIG. 3) described in the second embodiment.

Also, due to these metals or the metal oxides being unevenly distributed on the surfaces of the Ag particles in the present embodiment, the small amount of these metals or the metal oxides relative to the amount of Ag particles can produce substantial Ag colloid generation suppressing effect.

Accordingly, the present embodiment enables the yellowing of the panel to be prevented while securing the conductivity of the silver electrodes.

To effectively prevent Ag ions from diffusing, the amount of the metals or the metal oxides to coat the surfaces of the Ag particles should preferably be adjusted so that the average thickness of the coating layer is 0.1 $\mu$m or more (if particles are adhered to the surface, the thickness here means the thickness of the particles being converted into a uniform layer). If the coating layer is too thick, the conductivity is degraded. Therefore, it is preferable to set the thickness at 1 $\mu$m or less.

Also, in the present embodiment, a metal or a metal oxide to coat the Ag particles can be freely chosen from the several metals and the metal oxides listed above, taking the manufacturing conditions of the PDP or the accessibility of the materials into account. In this point, too, the present embodiment provides high values in practical use.

EXAMPLE 3

PDPs of No. 91 to No. 112 shown in Tables 7 and 8 are preferred examples, in which the display electrodes (the first electrode) and the address electrodes (the second electrodes) were formed using Ag particles (with the average particle diameter of 2 $\mu$m) each coated with a metal or a metal oxide based on the present embodiment.

In these preferred examples, when coating Ag particles with a metal, the average thickness of the metal layer was set in a range of 0.1 to 1.0 $\mu$m. When coating Ag particles with a metal oxide, the average thickness of the metal oxide layer was set in a range of 0.1 to 0.5 $\mu$m.

When using the photolithography method, powder of Ag particles each coated with a metal or a metal oxide and a PbO—$B_2O_2$—$SiO_2$ glass frit, and a photosensitive binder (with main constituents of binder resin, photopolymerization initiator, photosensitive monomer, and solvent, and minor constituents of dye, plasticizer, and polymerization inhibitor) were kneaded with a roll mill, to prepare a photosensitive silver paste. The photosensitive silver paste was then applied and patterned using the photolithography method, and then baked at the temperatures of 450 to 600° C. to form the silver electrodes.

When using the screen-printing method, powder of Ag particles each coated with a metal or a metal oxide and a PbO—$B_2O_2$—$SiO_2$ glass frit, and an organic vehicle (containing 5 to 10 wt % of ethyl cellulose, terpineol, and plasticizer) were kneaded with the roll mill, to prepare a silver paste for printing. The silver paste was then applied and patterned using the screen-printing method, and then baked at the temperatures of 450 to 600° C. to form the silver electrodes.

A PDP of No. 113 is a comparative example, in which uncoated Ag particles were used.

For the PDPs of No. 91 to No. 113 shown in Tables 7 and 8, the same specifications as in the first embodiment were used as to the cell size, the dielectric layer, the protective layer, and the discharge gas.

(Experiment 3)

For the front panels 10 of the PDPs of No. 91 to No. 113, the "a" value and the "b" value were measured in the same manner as in Experiment 1. Also, for the PDPs of No. 91 to No. 113, the color temperature of the full-white images was measured.

The experimental results are shown in Tables 7 and 8.

(Considerations)

For the PDP of No. 113 of the comparative example, the "b" value is +16.3. This indicates that severe yellowing is occurring. On the other hand, for the PDPs No. 91 to No. 112, the "b" value ranges from as low as −0.2 to 2.1. This indicates that these PDPs are superior with less yellowing.

Also, for the PDP (No. 113) of the comparative example, the color temperature is 6300° K. On the other hand, for the PDPs of the preferred examples, the color temperature ranges from as high as 8950 to 9720° K. This indicates that the PDPs of the preferred examples exhibit improved color reproduction and thereby enables more vivid display, compared with the PDP of the comparative example.

Note that when $Bi_2O_3$ glass or ZnO glass was used to form the transparent dielectric layer instead of PbO glass used above, the similar results were obtained.

Fourth Embodiment

A PDP relating to the present embodiment has the same construction as in the first embodiment, in which the silver electrodes were formed using general Ag particles. However, the difference lies in that, when forming the front panel 10, metal ions (that possess reducing action on Ag ions) exist in the vicinity of the surface of the front glass substrate 11 were processed to decrease its number and then the display electrodes 12 (silver electrodes) were formed.

In a normal glass substrate, especially in a glass substrate manufactured using the float method, a large number of metal ions that possess reducing action on silver exist in the vicinity of the surface (within a surface part of 5 μm in depth) of the glass substrate.

Here, specific examples of the "metal ions that possess reducing action on silver" are tin with less than four valence electrons, silicon with less than four valence electrons, aluminum with less than three valence electrons, sodium with less than one valence electron, potassium with less than one valence electron, magnesium with less than two valence electrons, calcium with less than two valence electrons, strontium with less than two valence electrons, barium with less than two valence electrons, zirconium with less than two valence electrons, manganese with less than four valence electrons, indium with less than four valence electrons, and iron with less than three valence electrons.

However, if the silver electrodes are formed after the processing that decreases the number of the metal ions that possess reducing action on Ag ions is performed as described above, the Ag ions are less likely to be reduced in the vicinity of the surface of the glass substrate 11. This prevents Ag colloids from being generated, thereby preventing the yellowing.

As specific methods to decrease the number of metal ions in the vicinity of the surface of the front glass substrate, the following describes the two methods (1) a method for etching the surface of the front glass substrate and (2) a method for baking the front glass substrate.

(1) Etching Method:

FIGS. 10A to 10C are for explaining the steps in which the surface of the front glass substrate 11 is subjected to an etching process to decrease the number of metal ions present there, and then the display electrodes 12 are formed.

Step 1: Etching Step

The front glass substrate 11 is subjected to an etching process. In the etching process, the front glass substrate 11 is soaked in an etching liquid (for example, a mixture of hydrofluoric acid and sulfuric acid) in an etching bath 101, and then the front glass substrate 11 is washed using a washer 102 and dried (FIG. 10A).

The present step removes the metal ions (the metal ions that possess reducing action on silver) that exist in the vicinity of the surface of the front glass substrate 11.

It is preferable to etch at least 5 μm in depth of the front glass substrate 11. This is because substantial yellowing preventing effect can be obtained when the etching is performed until as deep as at least 5 μm. This can be proved by the experiment which will be descried later.

However, the yellowing preventing effect cannot be improved by deeper etching. The time taken for the etching depends on the concentration of the mixture of hydrofluoric acid and sulfuric acid, but is almost proportional to the depth of the etching. Therefore, shallow etching is suitable for mass production. In view of this, it is preferable to set the depth of the etching at 15 μm or less.

Note that materials other than the mixture of hydrofluoric acid and sulfuric acid can be used as the etching liquid as long as it can etch a glass surface. As an example, hydrogen fluoride obtained by combining (a) fluoride such as calcium fluoride, aluminum fluoride soda, ammonium acid fluoride with (b) acid such as sulfuric acid and hydrochloric acid can be used.

Step 2: Polishing Step

The ununiformity (etching ununiformity) arises on the surface of the front glass substrate due to the etching performed in the etching step. In the present step, the ununiformity due to the etching is removed by polishing the surface.

The object of this polishing is to remove surface residues and the etching ununiformity, and the polishing for only a short period can achieve this object. That is to say, only a small amount of the surface can be polished away. Accordingly, this polishing does not cause the thickness of the glass substrate to be uneven.

For example, the polishing is performed using a belt-type polishing machine as shown in FIG. 10B.

The polishing machine is equipped with an abrasive sheet 103 and a cylinder 104. The glass substrate 11 is polished by the cylinder 104 pressing the abrasive sheet 103 against the glass substrate 11.

The polishing machine can be of any type as long as it can physically polish a glass surface. For example, the Oskar-type polishing device can be used.

Note that it is preferable to go through step 2 for providing a PDP with high uniformity by removing the etching ununiformity caused in the etching step. However, it is not indispensable to perform the present step.

The following describes (2) the method for baking the front glass substrate.

Step 1: Deactivating Step by Baking

Figure 11:
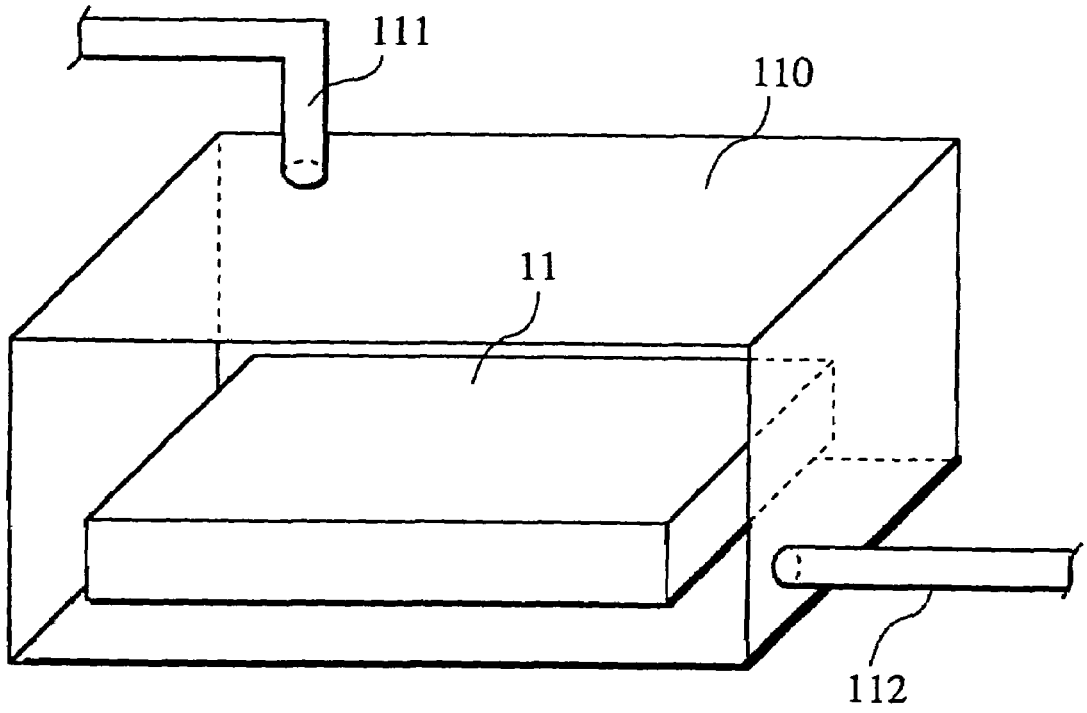
FIG. 11 is for explaining a deactivating process by baking the front glass substrate.

As illustrated in FIG. 11, the manufactured front glass substrate 11 is heated at the temperature of 500° C. or higher in a heating apparatus 110, and then the front glass substrate 11 is cooled down. In the present step, the metal ions (the metal ions that possess reducing action on silver) that exist in the vicinity of the surface of the glass substrate are oxidized and deactivated (the reducing action on silver is lost).

The heating of the front glass substrate 11 can be performed in a normal air atmosphere although it can alternatively be performed as shown in FIG. 7. In FIG. 7, the heating apparatus 110 is equipped with a gas supply line 111 and a gas exhaust line 112, and the front glass substrate 11 is heated while an oxidizing gas (such as oxygen or an air with high oxygen pressure) is being supplied from the gas supply line 111. In this way, the surface oxidizing process can be performed in a shorter period.

With either of the processing methods (1) or (2), the concentration of the metal ions present around the surface of the glass substrate 11 can be decreased.

To obtain sufficient yellowing preventing effect, the concentration of the metal ions that possess reducing action on Ag ions in the vicinity of the surface of the glass substrate (for example, in a part of the substrate from its surface to 5 μm in depth) should be decreased to 1000 ppm or lower. Note that the concentration can be measured with SIMS (secondary-ionization mass spectroscopy).

After processing the surface of the front glass substrate 11 as described above, the electrode precursors 120 are formed (FIG. 10C). The electrode precursors 120 are formed using silver powder mainly composed of silver, a glass frit, and an electrode paste including an organic binder, or are formed using a silver electrode film. The silver electrodes (display electrodes 12) are formed by baking the electrode precursors 120.

(Effects Produced by the Present Embodiment)

When the silver electrodes are baked, Ag ions diffuse around the silver electrodes in the front glass substrate 11. However, because the concentration of the metal ions that possess the reducing action on the Ag ions is reduced, the growth of Ag colloids can be prevented. Therefore, the yellowing of the front glass substrate 11 can be prevented.

On the display electrodes 12 (silver electrodes), the transparent dielectric layer 13 and the MgO protective layer 14 are formed in the stated order as in the first embodiment. This completes the front panel 10 with less yellowing occurring. Accordingly, a PDP that exhibits favorable color temperature characteristics can be manufactured using this front panel 10.

(Experiment Relating to the Degree of the Substrate Surface Processing and Considerations)

Figure 12A:
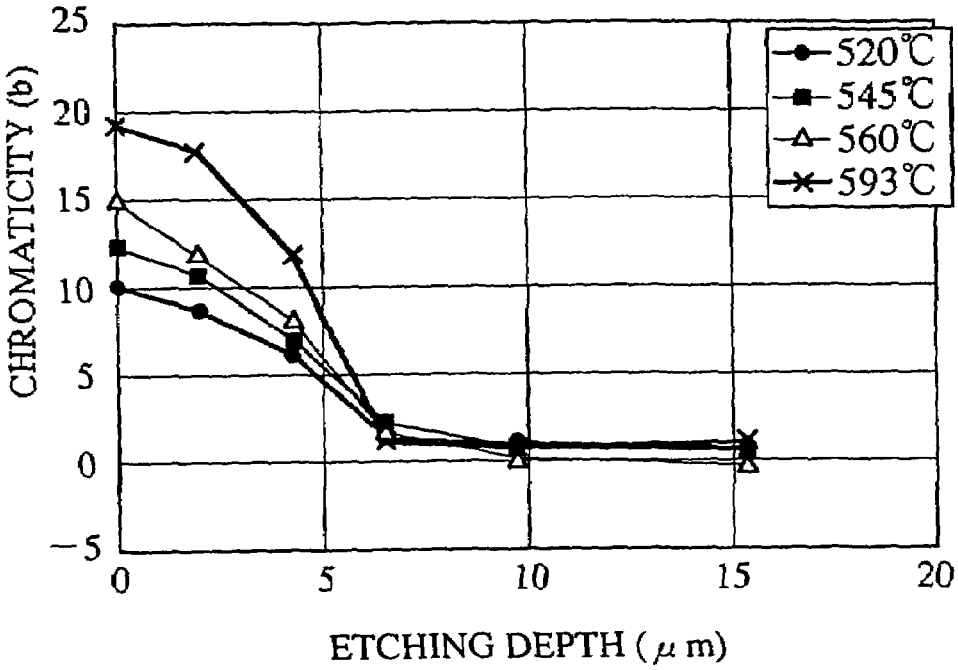
FIGS. 12A and 12B show experimental data relating to the etching depth of the glass substrate.

FIG. 12A shows experimental data showing the relation between the etching depth of the glass substrate and the chromaticity "b" when the silver electrodes and the dielectric layer were formed. This data was obtained according to the following measurement methods.

Glass substrates (PD200 manufactured by ASAHI GLASS COMPANY) were subjected to HF etching, each glass substrate being made varied in the etching width.

For each glass substrate, the silver electrodes were formed by printing an Ag paste using the screen-printing method, and baking the printed paste. The dielectric layer with the thickness of 23 μm was then formed by applying dielectric glass (#PLS-3244) and baking the applied glass twice at each of predetermined temperatures (520° C., 545° C., 560° C., and 593° C.).

The chromaticity "b" of each glass substrate was measured.

As can be seen from FIG. 12A, when the etching depth is 5 μm or more, values of the chromaticity "b" are relatively low, compared with when the etching depth is below 5 μm. Also, when the etching depth is 5 μm or more, values of the chromaticity "b" level off.

Figure 12B:
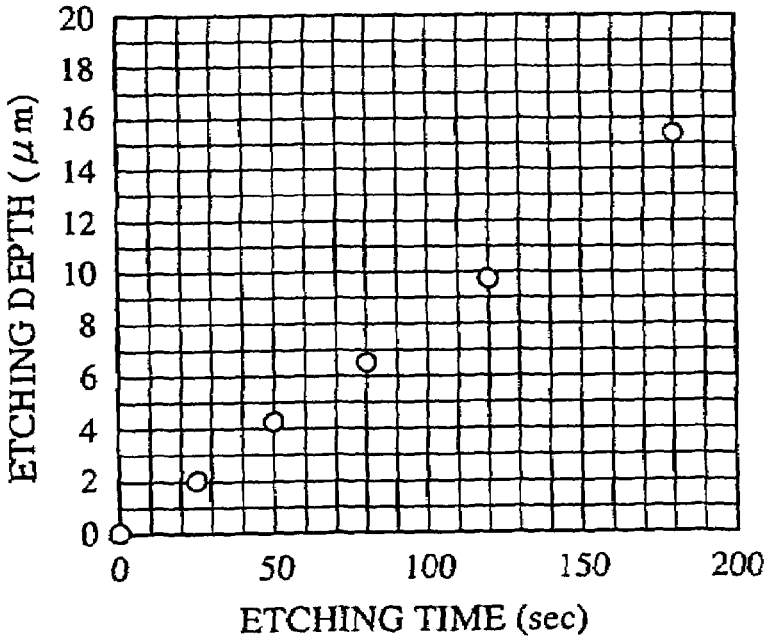

FIG. 12B shows experimental data showing the relation between the etching time and the etching depth when the glass substrate was subjected to etching using a 10% HF solution at the temperature of 225.5° C.

As can be seen from FIG. 12B, the etching depth is approximately proportional to the etching time.

EXAMPLE 4

PDPs of No. 121 to No. 127 shown in Table 9 are preferred examples in which the surface of the front glass substrate was subjected to etching and polishing processes based on the present embodiment.

As a front glass substrate, PD200 manufactured by ASAHI GLASS COMPANY using the float method was used. As an etching liquid, a mixture of 5% of hydrofluoric acid and 5% of sulfuric acid was used. As a polishing machine, an Oskar-type polishing device using cerium oxide as an abrasive was used.

The display electrodes were formed as follows. Ag particles, an organic vehicle mainly composed of ethyl cellulose, butyl carbitol acetate, and terpineol, a glass frit mainly composed of $Bi_2O_3$—$B_2O_3$—$SiO_2$ were kneaded to prepare a silver paste. The silver paste was printed and baked to form the display electrodes.

The PDPs of No. 128 to No. 131 are comparative examples, in which the processing to decrease the concentration of the metal ions that possess reducing action on Ag ions was not performed, or was not sufficiently performed.

For the PDPs of No. 121 to No. 131 shown in Table 9, the same specifications as in the first embodiment were used as to the cell size, the dielectric layer, the protective layer, and the discharge gas.

(Experiment 4)

For the front panels 10 of the PDPs of No. 121 to No. 131, the "a" value and the "b" value were measured in the same manner as in Experiment 1. Also, for the PDPs of No. 121 to No. 131, the color temperature of the full-white images was measured.

The experimental results are shown in Table 9.

For the PDPs No. 121 to No. 127 of the preferred example, in the region of 5 μm in depth from the surface of the front glass substrate, the amount of tin with less than four valence electrons, manganese with less than four valence electrons, iron with less than two valence electrons, and indium with less than two valence electrons was reduced to 1000 ppm or less.

(Considerations)

For the PDP of No. 129 on which the surface processing was not performed, and the PDP of No. 130 on which only the mechanical polishing was performed, the "b" value fairly exceeds 10. This indicates that severe yellowing is occurring.

On the other hand, for the PDPs No. 121 to No. 125 of the preferred examples on which the etching was performed with the etching depth of 5 μm or more, followed by the mechanical polishing, the "b" value ranges from as low as 0.5 to +3.8. This indicates that these PDPs are superior with less yellowing.

Also, for the PDP (No. 128) of the comparative example which was baked at the temperature of 400° C., the "b" value is as high as 15.0. On the other hand, for the PDPs of the preferred examples (No. 126 and 127) which were baked at the temperature of 500° C. or higher, the "b" value ranges from as low as 2.5 to 3.8. This indicates that these PDPs are superior with less yellowing.

The following can be found from this experiment. To deactivate the metal ions that possess reducing action on silver by heating the substrate, it is preferable to heat it at the temperature of 500° C. or higher.

Also, for the PDPs of No. 128 to No. 131 of the comparative examples, the color temperature is below 6900° K. On the other hand, for the PDPs of the preferred examples, the color temperature ranges from as high as 8900 to 9600° K. This indicates that these PDPs exhibit improved color reproduction and thereby enables more vivid display.

For the PDP of No. 131 on which the etching with the etching depth of as shallow as 1 μm was performed, the "b" value fairly exceeds 10. The reason for this phenomenon can be considered that the etching depth as shallow as 1 μm does not allow the concentration of the metal ions in the vicinity of the surface of the front glass substrate to be reduced to 1000 ppm or lower.

(Modifications of Preferred Embodiments)

The yellowing of the front panel has more considerable effect on image quality than the back panel. In view of this, preventing the yellowing of the front panel by processing the surface of the front glass substrate as described in the fourth embodiment would produce an enough effect to improve image quality such as the color temperature of a PDP. However, this effect can be increased more if the surface of the back glass substrate is processed in the-same way so as to prevent the yellowing of the back panel.

Moreover, the yellowing preventing effect can be increased further if the processing of the glass substrate surface described in the fourth embodiment is employed in combination with the use of the silver electrodes described in the first to third embodiments.

The simultaneous baking of the silver electrode precursors and the dielectric layer precursor was described in the second embodiment. This may also be applicable in the first and third embodiments. By doing so, the yellowing preventing effect can be improved further.

Although the first to third embodiments describe the case where the silver electrodes of the present invention were used as both the display electrodes and the address electrodes, the silver electrodes may only be used as the display electrodes in the front panel. In this case too, the effect to improve the image quality such as the color temperature of the PDP can be obtained. On the other hand, when the silver electrodes of the present invention are used only as the address electrodes, the yellowing preventing effect is degraded to some extent. However, in this case too, a certain effect can be obtained.

Although the first to fourth embodiments describe the AC surface discharge type PDP in which the silver electrodes are covered with the dielectric layer as one example, the present invention can also be applied to a DC-type PDP in which silver electrodes exposed to the discharge space are formed on the glass substrate, so that the same effect to prevent the glass substrate from yellowing can be produced.

Also, the present invention should not be limited to such a PDP that uses silver electrodes, but can be applied to a fluorescent display tube or an electroluminescent panel in which silver electrodes are arranged on a glass substrate, so that the same effect to prevent the glass substrate from yellowing can be produced.

INDUSTRIAL APPLICATION

The PDP and the PDP display apparatus of the present invention can effectively be used in display apparatuses for computers and televisions, and particularly in large-scale display apparatuses.

TABLE 1

| SAMPLE NUMBER | Ag ALLOY MATERIAL FOR FIRST AND SECOND ELECTRODES | COMPOSITION RATIO OF Ag ALLOY(wt %) | ELECTRODE FORMING METHOD AND THICKNESS | PANEL AFTER DIELECTRIC GLASS WAS BAKED(MEASURED WITH COLOUR-DIFFERENCE METER) a VALUE | b VALUE | COLOR TEMPERATURE OF PANEL(° K) |
|---|---|---|---|---|---|---|
| 1 | Ag—Cu | 85–15 | SPUTTERING, 3 μm | −1.2 | 3.0 | 8,500 |
| 2 | Ag—Co | 90–10 | SPUTTERING, 3 μm | −1.0 | 3.5 | 8,400 |
| 3 | Ag—Cr | 95–5 | SPUTTERING, 3 μm | −2.5 | 4.5 | 8,300 |
| 4 | Ag—Mn | 90–10 | SPUTTERING, 3 μm | −0.5 | 4.5 | 8,300 |
| 5 | Ag—Ni | 90–10 | SPUTTERING, 3 μm | −3.1 | 4.0 | 8,400 |
| 6 | Ag—Fe | 90–10 | SPUTTERING, 3 μm | −3.2 | 5.0 | 8,300 |
| 7 | Ag—Cu—Co | 90–5–5 | SPUTTERING, 3 μm | −2.1 | 1.5 | 8,950 |
| 8 | Ag—Cu—Ni | 85–10–5 | SPUTTERING, 3 μm | −1.3 | 3.5 | 8,500 |
| 9 | Ag—Cu—Cr | 85–10–5 | SPUTTERING, 3 μm | −2.0 | 0 | 9,200 |
| 10 | Ag—Cu—Mn | 85–10–5 | SPUTTERING, 3 μm | 0 | 3.3 | 8,600 |
| 11 | Ag—Cu—Fe | 85–10–5 | SPUTTERING, 3 μm | −2.2 | 2.1 | 8,700 |

TABLE 1-continued

| SAMPLE NUMBER | Ag ALLOY MATERIAL FOR FIRST AND SECOND ELECTRODES | COMPOSITION RATIO OF Ag ALLOY(wt %) | ELECTRODE FORMING METHOD AND THICKNESS | PANEL AFTER DIELECTRIC GLASS WAS BAKED(MEASURED WITH COLOUR-DIFFERENCE METER) a VALUE | b VALUE | COLOR TEMPERATURE OF PANEL(° K) |
|---|---|---|---|---|---|---|
| 12 | Ag—Cu—Co—Mn | 85–5–5–5 | SPUTTERING, 3 μm | −1.0 | 0 | 9,200 |
| 13* | Ag | 100 | SPUTTERING, 3 μm | −2.1 | 15 | 6,500 |

*SAMPLE NO. 13 IS COMPARATIVE EXAMPLE

TABLE 2

| SAMPLE NUMBER | COMPOSITION OF PHOTOSENSITIVE Ag PASTE USED FOR FIRST AND SECOND ELECTRODES(wt %) Ag POWDER | PHOTOSENSITIVE ORGANIC MATERIAL | GLASS FRIT MATERIAL | COMPOSITION OF GLASS FRIT MATERIAL(wt %) | PANEL AFTER Ag ELECTRODE AND DIELECTRIC GLASS WERE BAKED a VALUE | b VALUE | COLOR TEMPERATURE OF PANEL(° K) |
|---|---|---|---|---|---|---|---|
| 14 | 65 | 23 | 12 | $PbO—B_2O_3—SiO—CuO$ 65–15–10–10 | −2.2 | 2.4 | 8,990 |
| 15 | 65 | 23 | 12 | $PbO—B_2O_3—SiO—CoO$ 65–15–10–10 | −3.4 | 2.0 | 9,000 |
| 16 | 65 | 23 | 12 | $PbO—B_2O_3—SiO_2—Cr_2O_3$ 65–15–10–10 | −1.5 | 2.0 | 9,010 |
| 17 | 65 | 23 | 12 | $PbO—B_2O_3—SiO_2—MnO$ 65–15–10–10 | −1.6 | 3.5 | 8,400 |
| 18 | 65 | 23 | 12 | $PbO—B_2O_3—SiO_2—NiO$ 65–15–10–10 | −3.1 | 3.0 | 8,500 |
| 19 | 60 | 25 | 15 | $PbO—B_2O_3—SiO_2—Fe_2O_3$ 65–15–10–10 | −2.2 | 2.5 | 8,670 |
| 20 | 60 | 25 | 15 | $PbO—B_2O_3—SiO_2—CuO—CoO$ 65–15–10–5–5 | −3.2 | 1.5 | 9,050 |
| 21 | 60 | 25 | 15 | $PbO—B_2O_3—SiO_2—CuO—NiO$ 65–15–10–5–5 | −3.3 | 1.5 | 9,030 |
| 22 | 60 | 25 | 15 | $PbO—B_2O_3—SiO_2—CuO—Cr_2O_3$ 65–15–10–5–5 | −2.1 | 1.5 | 9,000 |
| 23 | 60 | 25 | 15 | $PbO—B_2O_3—SiO_2—CuO—MnO$ 65–15–10–5–5 | −1.5 | 2.0 | 8,850 |
| 24 | 60 | 25 | 15 | $PbO—B_2O_3—SiO_2—CuO—Fe_2O_3$ 65–15–10–5–5 | −2.0 | 1.0 | 9,020 |
| 25 | 60 | 25 | 15 | $PbO—B_2O_3—SiO_2—CuO—CoO—MnO$ 65–15–10–5–5–5 | −1.0 | 0 | 9,250 |
| 26* | 60 | 25 | 15 | $PbO—B_2O_3—SiO_2$ 65–20–15 | −3.2 | 16 | 6,300 |

*SAMPLE NO. 26 IS COMPARATIVE EXAMPLE

TABLE 3

| SAMPLE NUMBER | COMPOSITION OF Ag PASTE FOR PRINTING USED FOR FIRST AND SECOND ELECTRODES(wt %) Ag POWDER | ORGANIC VEHICLE | GLASS FRIT | COMPOSITION OF GLASS FRIT MATERIAL(wt %) | PANEL AFTER Ag ELECTRODE AND DIELECTRIC GLASS WERE BAKED a VALUE | b VALUE | COLOR TEMPERATURE OF PANEL(° K) |
|---|---|---|---|---|---|---|---|
| 27 | 65 | 25 | 10 | $Bi_2O_3—B_2O_3—SiO_2—CuO$ 60–20–10–10 | −2.5 | 2.5 | 8,850 |
| 28 | 65 | 25 | 10 | $Bi_2O_3—B_2O_3—SiO_2—CoO$ 60–20–10–10 | −3.5 | 2.2 | 8,930 |
| 29 | 65 | 25 | 10 | $Bi_2O_3—B_2O_3—SiO_2—Cr_2O_3$ 60–20–10–10 | −1.3 | 2.1 | 9,005 |
| 30 | 65 | 25 | 10 | $Bi_2O_3—B_2O_3—SiO_2—MnO_2$ 60–20–10–10 | −1.2 | 3.6 | 8,330 |
| 31 | 65 | 25 | 10 | $Bi_2O_3—B_2O_3—SiO_2—NiO$ 60–20–10–10 | −3.4 | 3.2 | 8,400 |
| 32 | 65 | 25 | 10 | $Bi_2O_3—B_2O_3—SiO_2—Fe_2O_3$ 60–20–10–10 | −2.5 | 2.7 | 8,650 |
| 33 | 60 | 25 | 15 | $Bi_2O_3—B_2O_3—SiO_2—CuO—CoO$ 60–20–10–5–5 | −3.3 | 1.6 | 9,080 |
| 34 | 60 | 25 | 15 | $Bi_2O_3—B_2O_3—SiO_2—CuO—Cr_2O_3$ 60–20–10–5–5 | −3.4 | 1.7 | 9,050 |

TABLE 3-continued

| SAMPLE NUMBER | COMPOSITION OF Ag PASTE FOR PRINTING USED FOR FIRST AND SECOND ELECTRODES(wt %) Ag POWDER | ORGANIC VEHICLE | GLASS FRIT | COMPOSITION OF GLASS FRIT MATERIAL(wt %) | PANEL AFTER Ag ELECTRODE AND DIELECTRIC GLASS WERE BAKED a VALUE | b VALUE | COLOR TEMPERATURE OF PANEL(° K) |
|---|---|---|---|---|---|---|---|
| 35 | 60 | 25 | 15 | $Bi_2O_3$—$B_2O_3$—$SiO_2$—CuO—MnO 60–20–10–5–5 | −2.5 | 1.9 | 9,000 |
| 36 | 60 | 25 | 15 | $Bi_2O_3$—$B_2O_3$—$SiO_2$—CuO—NiO 60–20–10-5–5 | −1.6 | 2.2 | 8,930 |
| 37 | 60 | 25 | 15 | $Bi_2O_3$—$B_2O_3$—$SiO_2$—CuO—$Fe_2O_3$ 60–20–10–5–5 | −2.1 | 1.1 | 9,100 |
| 38 | 60 | 25 | 15 | $Bi_2O_3$—$B_2O_3$—$SiO_2$—CuO—CoO—MnO 55–20–10–5–5–5 | −1.1 | 0 | 9,250 |
| 39* | 60 | 25 | 15 | $Bi_2O_3$—$B_2O_3$—$SiO_2$ 60–20–20 | −3.0 | 16.2 | 6,290 |

*SAMPLE NO. 39 IS COMPARATIVE EXAMPLE

TABLE 4

| SAMPLE NUMBER | COMPOSITION OF PHOTOSENSITIVE Ag PASTE USED FOR FIRST AND SECOND ELECTRODES(wt %) Ag POWDER | PHOTOSENSITIVE ORGANIC MATERIAL | GLASS FRIT MATERIAL | COMPOSITION OF GLASS FRIT MATERIAL(wt %) | PANEL AFTER Ag ELECTRODE AND DIELECTRIC GLASS WERE BAKED a VALUE | b VALUE | COLOR TEMPERATURE OF PANEL(° K) |
|---|---|---|---|---|---|---|---|
| 40 | 65 | 23 | 12 | ZnO—$B_2O_3$—$SiO_2$—CuO 30–40–15–15 | −2.0 | 2.3 | 8,700 |
| 41 | 65 | 23 | 12 | ZnO—$B_2O_3$—$SiO_2$—CoO 30–40–15–15 | −3.1 | 2.0 | 8,950 |
| 42 | 65 | 23 | 12 | ZnO—$B_2O_3$—$SiO_2$—$Cr_2O_3$ 30–40–15–15 | −1.4 | 1.8 | 9,003 |
| 43 | 65 | 23 | 12 | ZnO—$B_2O_3$—$SiO_2$—MnO 30–40–15–15 | −1.7 | 3.2 | 8,650 |
| 44 | 65 | 23 | 12 | ZnO—$B_2O_3$—$SiO_2$—NiO 30–40–15–15 | −3.0 | 2.9 | 8,550 |
| 45 | 65 | 23 | 12 | ZnO—$B_2O_3$—$SiO_2$—$Fe_2O_3$ 30–40–15–15 | −2.2 | 2.4 | 8,690 |
| 46 | 70 | 20 | 10 | ZnO—$B_2O_3$—$SiO_2$—CuO—CoO 30–40–10–15–5 | −3.2 | 1.3 | 9,154 |
| 47 | 70 | 20 | 10 | ZnO—$B_2O_3$—$SiO_2$—CuO—$Cr_2O_3$ 30–40–10–15–5 | −3.4 | 1.4 | 9,053 |
| 48 | 70 | 20 | 10 | ZnO—$B_2O_3$—$SiO_2$—$Cr_2O_3$—NiO 30–40–10–10–10 | −2.0 | 1.3 | 9,130 |
| 49 | 70 | 20 | 10 | ZnO—$B_2O_3$—$SiO_2$—$Cr_2O_3$—MnO 30–40–10–10–10 | −1.5 | 2.0 | 8,930 |
| 50 | 70 | 20 | 10 | ZnO—$B_2O_3$—$SiO_2$—MnO—NiO 30–40–10–10–10 | −2.0 | 0.8 | 9,200 |
| 51 | 70 | 20 | 10 | ZnO—$B_2O_3$—$SiO_2$—CoO—MnO—NiO 30–40–10–10–5–5 | −1.1 | 0.1 | 9,250 |
| 52* | 70 | 20 | 10 | ZnO—$B_2O_3$—$SiO_2$ 30–40–30 | −3.3 | 14 | 6,350 |

*SAMPLE NO. 52 IS COMPARATIVE EXAMPLE

TABLE 5

| SAMPLE NUMBER | COMPOSITION OF Ag ALLOY MATERIAL FOR Ag POWDER USED FOR FIRST AND SECOND ELECTRODES | COMPOSITION RATE OF Ag ALLOY (wt %) | TEMPERATURE AT WHICH Ag ELECTRODE IS BAKED | COMPOSITION OF DIELECTRIC GLASS | TEMPERATURE AT WHICH DIELECTRIC MATERIAL IS BAKED | PANEL AFTER DIELECTRIC GLASS WAS BAKED (MEASURED WITH COLOUR-DIFFERENCE METER) a VALUE | b VALUE | COLOR TEMPERATURE OF PANEL (° K) |
|---|---|---|---|---|---|---|---|---|
| 61 | Ag—Ru | 99–1 | 590° C. | PbO—$B_2O_3$—$SiO_2$—CaO | 590° C. | −1.0 | 2.5 | 8,750 |
| 62 | Ag—Re | 90–10 | 590° C. | PbO—$B_2O_3$—$SiO_2$—CaO | 590° C. | −1.3 | 3.0 | 8,500 |
| 63 | Ag—Rh | 95–5 | 590° C. | PbO—$B_2O_3$—$SiO_2$—CaO | 590° C. | −2.0 | 3.9 | 8,300 |
| 64 | Ag—Os | 90–10 | 590° C. | ZnO—$B_2O_3$—$SiO_2$—$K_2O$ | 590° C. | −1.5 | 3.8 | 8,350 |
| 65 | Ag—Ir | 90–10 | 590° C. | $Bi_2O_3$—ZnO—$SiO_2$ | 590° C. | −2.6 | 3.4 | 8,410 |
| 66* | Ag—Pd | 90–10 | 590° C. | PbO—$B_2O_3$—$SiO_2$—CaO | 590° C. | −3.0 | 4.0 | 8,300 |

TABLE 5-continued

| SAMPLE NUMBER | COMPOSITION OF Ag ALLOY MATERIAL FOR Ag POWDER USED FOR FIRST AND SECOND ELECTRODES | COMPOSITION RATE OF Ag ALLOY (wt %) | TEMPERATURE AT WHICH Ag ELECTRODE IS BAKED | COMPOSITION OF DIELECTRIC GLASS | TEMPERATURE AT WHICH DIELECTRIC MATERIAL IS BAKED | PANEL AFTER DIELECTRIC GLASS WAS BAKED (MEASURED WITH COLOUR-DIFFERENCE METER) a VALUE | b VALUE | COLOR TEMPERATURE OF PANEL (° K) |
|---|---|---|---|---|---|---|---|---|
| 67 | Ag—Ru—Re | 90–5–5 | 590° C. | $PbO—B_2O_3—SiO_2—CaO$ | 590° C. | −1.1 | 0.5 | 9,030 |
| 68 | Ag—Ru—Rh | 85–10–5 | 590° C. | $PbO—B_2O_3—SiO_2—CaO$ | 590° C. | −1.0 | 1.5 | 8,950 |
| 69 | Ag—Ru—Os | 85–10–5 | 590° C. | $PbO—B_2O_3—SiO_2—CaO$ | 590° C. | −1.0 | 0 | 9,200 |
| 70 | Ag—Ru—Ir | 85–10–5 | 590° C. | $PbO—B_2O_3—SiO_2—CaO$ | 590° C. | −1.2 | 2.0 | 8,800 |
| 71 | Ag—Ru—Pd | 85–10–5 | 590° C. | $PbO—B_2O_3—SiO_2—CaO$ | 590° C. | −2.0 | 1.8 | 8,860 |
| 72 | Ag—Ru—Os—Re | 85–5–5–5 | 590° C. | $PbO—B_2O_3—SiO_2—CaO$ | 590° C. | 1.0 | 0 | 9,200 |
| 73* | Ag | 100 | 590° C. | $PbO—B_2O_3—SiO_2—CaO$ | 590° C. | −2.1 | 15 | 6,500 |

*SAMPLE NO. 73 IS COMPARATIVE EXAMPLE,
*SAMPLE NO. 66 IS REFERENCE EXAMPLE

TABLE 6

| SAMPLE NUMBER | COMPOSITION OF PHOTOSENSITIVE Ag PASTE USED IN FIRST AND SECOND ELECTRODES(wt %) Ag POWDER | PHOTOSENSITIVE ORGANIC MATERIAL | GLASS FRIT MATERIAL | COMPOSITION OF GLASS FRIT MATERIAL(wt %) | PANEL AFTER Ag ELECTRODE AND DIELECTRIC GLASS WERE BAKED a VALUE | b VALUE | COLOR TEMPERATURE OF PANEL(° K) |
|---|---|---|---|---|---|---|---|
| 74 | 65 | 23 | 12 | $PbO—B_2O_3—SiO—RuO_2$ 75–15–5–5 | −2.0 | 2.2 | 9,000 |
| 75 | 65 | 23 | 12 | $PbO—B_2O_3—SiO—ReO_2$ 75–15–5–5 | −3.0 | 1.9 | 9,020 |
| 76 | 65 | 23 | 12 | $PbO—B_2O_3—SiO_2—IrO_2$ 75–15–5–5 | −1.5 | 1.8 | 9,030 |
| 77 | 65 | 23 | 12 | $PbO—B_2O_3—SiO_2—RhO$ 75–15–5–5 | −1.6 | 3.0 | 8,450 |
| 78 | 65 | 23 | 12 | $PbO—B_2O_3—SiO_2—OsO_2$ 75–15–5–5 | −3.0 | 2.5 | 8,650 |
| 79 | 60 | 25 | 15 | $PbO—B_2O_3—SiO_2—PdO$ 75–15–5–5 | −2.2 | 2.4 | 8,700 |
| 80 | 60 | 25 | 15 | $PbO—B_2O_3—SiO_2—RuO_2—ReO_2$ 75–10–5–5–5 | −3.1 | 1.3 | 9,100 |
| 81 | 60 | 25 | 15 | $Bi_2O_3—B_2O_3—SiO_2—RuO_2$ 75–15–5–5 | −3.2 | 1.5 | 9,030 |
| 82 | 60 | 25 | 15 | $Bi_2O_3—B_2O_3—SiO_2—RuO_2—ReO_2$ 75–10–5–5–5 | −2.1 | 1.4 | 9,040 |
| 83 | 60 | 25 | 15 | $Bi_2O_3—B_2O_3—SiO_2—RuO_2—OsO_2$ 75–10–5–5–5 | −1.5 | 2.0 | 8,850 |
| 84 | 60 | 25 | 15 | $P_2O_5—B_2O_3—SiO_2—ReO_2—PdO$ 75–10–5–5–5 | −2.0 | 1.0 | 9,100 |
| 85 | 60 | 25 | 15 | $P_2O_5—B_2O_3—SiO_2—RuO_2—ReO_2$ 75–10–5–5–5 | −1.0 | 0 | 9,250 |
| 86* | 60 | 25 | 15 | $PbO—B_2O_3—SiO_2$ 65–20–15 | −3.2 | 16 | 6,300 |

*SAMPLE NO. 86 IS COMPARATIVE EXAMPLE

TABLE 7

| SAMPLE NUMBER | COATING MATERIAL FOR Ag PARTICLE (TYPE/PARTICLE DIAMETER) | | COATING METHOD | FORM OF PASTE | ELECTRODE FORMING METHOD | TEMPERATURE AT WHICH DIELECTRIC MATERIAL IS BAKED | PANEL AFTER DIELECTRIC GLASS WAS BAKED a VALUE | b VALUE | COLOR TEMPERATURE OF PANEL (° K) |
|---|---|---|---|---|---|---|---|---|---|
| 91 | Pd | 0.2 μm | PLATING METHOD | PHOTO PASTE | PHOTOLITHOGRAPHY METHOD | 590° C. | −1.3 | 1.5 | 9020 |
| 92 | Cu | 0.1 μm | PLATING METHOD | PHOTO PASTE | PHOTOLITHOGRAPHY METHOD | 590° C. | −2.2 | 2.1 | 8950 |
| 93 | Ni | 0.1 μm | PLATING METHOD | PHOTO PASTE | PHOTOLITHOGRAPHY METHOD | 590° C. | −2.0 | 1.8 | 9010 |
| 94 | Co | 0.1 μm | PLATING METHOD | PRINT PASTE | SCREEN-PRINTING METHOD | 590° C. | −2.2 | 1.2 | 9035 |

TABLE 7-continued

| SAMPLE NUMBER | COATING MATERIAL FOR Ag PARTICLE (TYPE/PARTICLE DIAMETER) | | COATING METHOD | FORM OF PASTE | ELECTRODE FORMING METHOD | TEMPERATURE AT WHICH DIELECTRIC MATERIAL IS BAKED | PANEL AFTER DIELECTRIC GLASS WAS BAKED a VALUE | b VALUE | COLOR TEMPERATURE OF PANEL (° K) |
|---|---|---|---|---|---|---|---|---|---|
| 95 | Cr | 0.1 μm | PLATING METHOD | PRINT PASTE | SCREEN-PRINTING METHOD | 590° C. | −2.0 | 1.3 | 9030 |
| 96 | Rh | 0.5 μm | PLATING METHOD | PRINT PASTE | SCREEN-PRINTING METHOD | 590° C. | −1.2 | 1.1 | 9050 |
| 97 | Ir | 0.6 μm | PLATING METHOD | PRINT PASTE | SCREEN-PRINTING METHOD | 590° C. | −1.0 | 0.5 | 9500 |
| 98 | Ru | 0.3 μm | PLATING METHOD | PRINT PASTE | SCREEN-PRINTING METHOD | 590° C. | −1.2 | 0.7 | 9450 |
| 99 | Pd | 1.0 μm | MECHANOFUSION METHOD | PHOTO PASTE | PHOTOLITHOGRAPHY METHOD | 590° C. | −1.2 | 1.0 | 9100 |
| 100 | Cu | 1.0 μm | MECHANOFUSION METHOD | PHOTO PASTE | PHOTOLITHOGRAPHY METHOD | 590° C. | −2.0 | 1.8 | 9015 |
| 101 | Ni | 0.5 μm | MECHANOFUSION METHOD | PHOTO PASTE | PHOTOLITHOGRAPHY METHOD | 590° C. | −1.5 | 1.2 | 9040 |
| 102 | Rh | 0.3 μm | MECHANOFUSION METHOD | PHOTO PASTE | PHOTOLITHOGPAPHY METHOD | 590° C. | −1.0 | 0.8 | 9320 |

TABLE 8

| SAMPLE NUMBER | COATING MATERIAL FOR Ag PARTICLE (TYPE/PARTICLE DIAMETER) | | COATING METHOD | FORM OF PASTE | ELECTRODE FORMING METHOD | TEMPERATURE AT WHICH DIELECTRIC MATERIAL IS BAKED | PANEL AFTER DIELECTRIC GLASS WAS BAKED a VALUE | b VALUE | COLOR TEMPERATURE OF PANEL (° K) |
|---|---|---|---|---|---|---|---|---|---|
| 103 | $Al_2O_3$ | 0.1 μm | MECHANOFUSION METHOD | PHOTO PASTE | PHOTOLITHOGRAPHY METHOD | 590° C. | −1.2 | 1.0 | 9105 |
| 104 | NiO | 0.1 μm | MECHANOFUSION METHOD | PHOTO PASTE | PHOTOLITHOGRAPHY METHOD | 590° C. | −2.1 | 1.9 | 9002 |
| 105 | $ZrO_2$ | 0.1 μm | SOL-GEL METHOD | PHOTO PASTE | PHOTOLITHOGRAPHY METHOD | 590° C. | −1.1 | 0.8 | 9310 |
| 106 | CoO | 0.1 μm | MECHANOFUSION METHOD | PRINT PASTE | PRINTING METHOD | 590° C. | −2.2 | 1.4 | 9018 |
| 107 | $Fe_2O_3$ | 0.2 μm | MECHANOFUSION METHOD | PRINT PASTE | PRINTING METHOD | 590° C. | −2.0 | 1.5 | 9020 |
| 108 | ZnO | 0.2 μm | SOL-GEL METHOD | PRINT PASTE | PRINTING METHOD | 590° C. | −1.0 | 0.5 | 9510 |
| 109 | $In_2O_3$ | 0.5 μm | SOL-GEL METHOD | PHOTO PASTE | PHOTOLITHOGRAPHY METHOD | 590° C. | −0.8 | 0.3 | 9620 |
| 110 | CuO | 0.5 μm | SOL-GEL METHOD | PHOTO PASTE | PHOTOLITHOGRAPHY METHOD | 590° C. | −2.1 | 1.3 | 9032 |
| 111 | $TiO_2$ | 0.2 μm | MECHANOFUSION METHOD | PHOTO PASTE | PHOTOLITHOGRAPHY METHOD | 590° C. | −1.5 | 1.2 | 9045 |
| 112 | $Pr_6O_{11}$ | 0.5 μm | MECHANOFUSION METHOD | PHOTO PASTE | PHOTOLITHOGRAPHY METHOD | 590° C. | −1.0 | 0.2 | 9720 |
| 113* | NONE | | NONE | PHOTO PASTE | PHOTOLITHOGRAPHY METHOD | 590° C. | −10.5 | 10.3 | 6300 |

*SAMPLE NO. 113 IS COMPARATIVE EXAMPLE

TABLE 9

| SAMPLE NUMBER | PRE-BAKING OF SUBSTRATE PERFORMED OR NOT | TEMPERATURE | ETCHING PERFORMED OR NOT | DEPTH | MECHANICAL POLISHING | PANEL AFTER DIELECTRIC GLASS WAS BAKED b VALUE | SCATTER | COLOR TEMPERATURE OF PANEL(° K) |
|---|---|---|---|---|---|---|---|---|
| 121 | NOT PERFORMED | — | PERFORMED | 5 μm | NOT PERFORMED | 3.0 | ±2.0 | 9,000 |
| 122 | NOT PERFORMED | — | PERFORMED | 5 μm | PERFORMED | 3.1 | ±0.5 | 9,010 |
| 123 | NOT PERFORMED | — | PERFORMED | 10 μm | PERFORMED | 1.0 | ±0.5 | 9,010 |
| 124 | NOT PERFORMED | — | PERFORMED | 15 μm | PERFORMED | 0.8 | ±0.5 | 9,010 |
| 125 | NOT PERFORMED | — | PERFORMED | 20 μm | PERFORMED | 0.8 | ±0.5 | 9,010 |
| 126 | PERFORMED | 500° C. | NOT PERFORMED | — | NOT PERFORMED | 3.8 | ±0.6 | 8,900 |
| 127 | PERFORMED | 600° C. | NOT PERFORMED | — | NOT PERFORMED | 2.5 | ±0.7 | 9,600 |
| 128 | PERFORMED | 400° C. | NOT PERFORMED | — | NOT PERFORMED | 15.0 | ±0.5 | 6,900 |

TABLE 9-continued

| SAMPLE NUMBER | PRE-BAKING OF SUBSTRATE PERFORMED OR NOT | TEMPERATURE | ETCHING PERFORMED OR NOT | DEPTH | MECHANICAL POLISHING | PANEL AFTER DIELECTRIC GLASS WAS BAKED b VALUE | SCATTER | COLOR TEMPERATURE OF PANEL(° K) |
|---|---|---|---|---|---|---|---|---|
| 129 | NOT PERFORMED | — | NOT PERFORMED | — | NOT PERFORMED | 14.0 | ±0.7 | 6,900 |
| 130 | NOT PERFORMED | — | NOT PERFORMED | — | PERFORMED | 15.0 | ±0.8 | 6,500 |
| 131 | NOT PERFORMED | — | PERFORMED | 1 μm | NOT PERFORMED | 16.0 | ±0.6 | 6,300 |

*SAMPLES NO. 128 TO 131 ARE COMPARATIVE EXAMPLES

What is claimed is:

1. A plasma display panel comprising a first plate and a second plate that face each other with a space therebetween, the first plate having first electrodes on a facing surface thereof, the second plate having second electrodes on a facing surface thereof, the space being filled with a gas medium, wherein the first electrodes, or both the first electrodes and the second electrodes include silver electrodes made of Ag and glass that contain transition metal oxide $Mn_2O_3$.

2. The plasma display panel of claim 1, wherein an amount of the transition metal oxide contained in the glass is in a range of 5 wt % to 20 wt % inclusive.

3. The plasma display panel of claim 2, wherein the first electrodes are constructed by forming each electrode on a transparent electrode film.

4. The plasma display panel of claim 2, wherein the first electrodes are covered with a dielectric layer made of a dielectric lass material.

5. The plasma display panel of claim 1, wherein the glass is one of PbO glass, $Bi_2O_3$ glass, and ZnO glass.

6. The plasma display panel of claim 5, wherein the first electrodes are constructed by forming each electrode on a transparent electrode film.

7. The plasma display panel of claim 5, wherein the first electrodes are covered with a dielectric layer made of a dielectric glass material.

8. The plasma display panel of claim 1, wherein the first electrodes are constructed by forming each electrode on a transparent electrode film.

9. The plasma display panel of claim 1, wherein the first electrodes are covered with a dielectric layer made of a dielectric lass material.

10. A display apparatus comprising:

the plasma display panel of claim 1; and a driving circuit that drives the plasma display panel.

11. A plasma display panel comprising a first plate and a second plate that face each other with a space therebetween, the first plate having first electrodes on a facing surface thereof, the second plate having second electrodes on a facing surface thereof, the space being filled with a gas medium, wherein the first electrodes, or both the first electrodes and the second electrodes include silver electrodes made of Ag and glass that contain at least one metal oxide selected from the group consisting of RhO, $IrO_2$, $OsO_2$, and $ReO_2$.

12. The plasma display panel of claim 11, wherein an amount of the metal oxide contained in the glass is in a range of 5 wt % to 20 wt% inclusive.

13. The plasma display panel of claim 12, wherein the first electrodes are covered with a dielectric layer made of a dielectric glass material.

14. The plasma display panel of claim 11, wherein the glass is one of PbO—$B_2O_3$—$SiO_2$ glass, $Bi_2O_3$—$B_2O_3$—$SiO_2$ glass, and $P_2O_5$—$B_2O_3$—$SiO_2$ glass.

15. The plasma display panel of claim 14, wherein the first electrodes are covered with a dielectric layer made of a dielectric glass material.

16. The plasma display panel of claim 11, wherein the first electrodes are covered with a dielectric layer made of a dielectric glass material.

17. A display apparatus comprising:

the plasma display panel of claim 11; and a driving circuit that drives the plasma display panel.

18. A manufacturing method for a plasma display panel comprising:

a first electrode arrangement step for arranging first electrodes on a surface of a first plate;

a second electrode arrangement step for arranging second electrodes on a surface of a second plate; and a placement step for (a) placing the first plate and the second plate with a space therebetween, so that the first electrodes and the second electrodes face each other, and (b) enclosing a gas medium in the space between the first plate and the second plate, wherein the first electrode arrangement step, or both the first electrode arrangement step and the second electrode arrangement step include an electrode formation step for forming silver electrodes, by (a) forming a film made of a mixture of silver and a glass frit, the glass frit containing transition metal oxide $Mn_2O_3$, (b) patterning the formed film, and (c) baking the patterned film.

19. A manufacturing method for a plasma display panel comprising:

a first electrode arrangement step for arranging first electrodes on a surface of a first plate;

a second electrode arrangement step for arranging second electrodes on a surface of a second plate; and a placement step for (a) placing the first plate and the second plate with a space therebetween, so that the first electrodes and the second electrodes face each other, and (b) enclosing a gas medium in the space between the first plate and the second plate, wherein the first electrode arrangement step, or both the first electrode arrangement step and the second electrode arrangement step include a silver electrode formation step for forming silver electrodes by (a) forming a film made of a mixture of silver and a glass frit, the glass frit containing a transition metal oxide, (b) patterning the formed film, and (c) baking the patterned film, the transition metal oxide including at least one selected from the group consisting of RhO, $IrO_2$, $OsO_2$, and $ReO_2$.

* * * * *